US010563430B2

(12) United States Patent
Hertrich

(10) Patent No.: US 10,563,430 B2
(45) Date of Patent: Feb. 18, 2020

(54) SECURE LATCH ASSEMBLY FOR DRAWERS AND DOORS

(71) Applicant: Gregory P. Hertrich, Longmont, CO (US)

(72) Inventor: Gregory P. Hertrich, Longmont, CO (US)

( * ) Notice: Subject to any disclaimer, the term of this patent is extended or adjusted under 35 U.S.C. 154(b) by 0 days.

(21) Appl. No.: 16/388,323

(22) Filed: Apr. 18, 2019

(65) Prior Publication Data

US 2019/0323267 A1 Oct. 24, 2019

Related U.S. Application Data

(60) Provisional application No. 62/662,164, filed on Apr. 24, 2018.

(51) Int. Cl.

| | |
|---|---|
| ***E05B 65/462*** | (2017.01) |
| ***A47B 88/50*** | (2017.01) |
| ***A47B 88/95*** | (2017.01) |
| ***A47B 88/42*** | (2017.01) |

(52) U.S. Cl.

CPC ..... *E05B 65/462* (2013.01); *A47B 88/42* (2017.01); *A47B 88/50* (2017.01); *A47B 88/95* (2017.01); *A47B 2088/954* (2017.01)

(58) Field of Classification Search

CPC ..... A47B 88/50; E05B 65/46

See application file for complete search history.

(56) References Cited

U.S. PATENT DOCUMENTS

| | | | | |
|---|---|---|---|---|
| 1,011,637 A | | 12/1911 | Moebes, Jr. et al. | |
| 1,546,255 A | | 7/1925 | Rotzell | |
| 2,532,586 A | | 12/1950 | Wickwire | |
| 3,069,217 A | | 12/1962 | Kors | |
| 3,181,319 A | | 5/1965 | Hudon | |
| 3,437,365 A | * | 4/1969 | Zadanoff | E05B 65/0014 292/202 |
| 3,834,746 A | | 9/1974 | Hinden | |
| 4,195,867 A | | 4/1980 | Baillie | |
| 4,763,938 A | | 8/1988 | Schlanger | |
| 5,114,194 A | | 5/1992 | Toifl et al. | |
| 5,209,533 A | | 5/1993 | Menard | |

(Continued)

FOREIGN PATENT DOCUMENTS

| | | |
|---|---|---|
| GB | 2103708 A | 2/1983 |

*Primary Examiner* — Daniel J Rohrhoff

(74) *Attorney, Agent, or Firm* — Roeder & Broder LLP; Steven G. Roeder

(57) ABSTRACT

A latch assembly for use with a cabinet that includes a cabinet body having a cabinet face and a moving component that moves relative to the cabinet face, includes an attachment assembly and a locking assembly. The attachment assembly is selectively coupled to the cabinet face. The attachment assembly includes an attacher body having a first arm that provides pressure on a back of the cabinet face, and a second arm that provides pressure on a front of the cabinet face when the attachment assembly is coupled to the cabinet face. The second arm is flexibly coupled to the first arm. The locking assembly is coupled to the attachment assembly. The locking assembly is selectively movable between a locked position, when the moving component is inhibited from moving relative to the cabinet face, and an unlocked position, when the moving component can be freely moved relative to the cabinet face.

20 Claims, 23 Drawing Sheets

(56) References Cited

U.S. PATENT DOCUMENTS

| | | | | |
|---|---|---|---|---|
| 6,481,811 | B1 * | 11/2002 | Marsh | E05C 19/06 24/3.12 |
| 6,604,764 | B2 | 8/2003 | Zemzik | |
| 6,874,825 | B1 * | 4/2005 | Rauner | E05B 65/0014 292/175 |
| 8,544,899 | B2 * | 10/2013 | Hertrich | E05B 65/0014 292/195 |
| 8,833,118 | B1 * | 9/2014 | McLane | E05C 1/08 70/85 |
| 2010/0172079 | A1 | 7/2010 | Wu et al. | |
| 2019/0249461 | A1 * | 8/2019 | Herskovitz | E05B 17/0058 |

* cited by examiner

SECURE LATCH ASSEMBLY FOR DRAWERS AND DOORS

RELATED APPLICATIONS

This application claims priority on U.S. Provisional Application Ser. No. 62/662,164 filed on Apr. 24, 2018, and entitled "SECURE LATCHING DEVICE FOR DRAWERS AND DOORS". As far as permitted, the contents of U.S. Provisional Application Ser. No. 62/662,164 are incorporated in their entirety herein by reference.

Additionally, this application is related to U.S. Pat. No. 8,544,899 issued on Oct. 1, 2013, and entitled "SECURE LATCH ASSEMBLY FOR DRAWERS AND DOORS". As far as permitted, the contents of U.S. Pat. No. 8,544,899 are incorporated in their entirety herein by reference.

BACKGROUND

For years, "child-proof" safety latch assemblies, or "safety latches", have been designed and used, primarily in households, to prevent access by young children to drawers and doors of cabinets that may store potentially harmful or dangerous items. Such safety latches are typically designed to be difficult for young children to operate, but may be easily operated by an adult.

Unfortunately, previous safety latches have experienced a variety of drawbacks. For example, in some cases, installation and proper adjustment of the safety latches can be time-consuming and difficult when ensuring that components are mounted and aligned properly, especially in the confined cabinet spaces in which such safety latches are typically employed. Additionally, some existing safety latches can cause the cabinet surfaces on which the latch operates to become marred or damaged due to the manner in which the safety latch is secured to the cabinet. For example, many presently available safety latches require drilling or adhesives to secure the safety latch to the drawers and doors of the cabinets. Adhesive-mounted devices sometimes provide unreliable adhesive strength, but may also cause damage to the cabinet finish upon removal. Further, some existing safety latches operate by allowing the door or drawer panel to be opened to a limited extent (also sometimes referred to herein as "pre-travel"), in order to activate or deactivate the latch mechanism. With such safety latches, this slight opening of the cabinet door or drawer can result in babies and/or young children getting their fingers pinched between the door or drawer and the body of the cabinet. Additionally, such pre-travel can also provide excessive dynamic loading on existing latches as users often like to open and close the cabinet door or drawer by slamming it back and forth.

Accordingly, it is desired to provide a safety latch that is able to effectively overcome the various drawbacks associated with presently available safety latches. Additionally, it is appreciated that many kitchen and bathroom cabinets have bumpers between the door or drawer and the front face of the cabinet. These bumpers can have varying thicknesses for a given cabinet design, and other properties such as sound dampening. Thus, it is further desired to provide a safety latch that can work effectively with cabinets, with or without such bumpers, e.g., even with cabinets using bumpers of the largest thickness found to date.

SUMMARY

The present invention is directed to a latch assembly for use with a cabinet that includes a cabinet body having a cabinet face and a moving component that is configured to move relative to the cabinet face. In various embodiments, the latch assembly includes an attachment assembly and a locking assembly. The attachment assembly is selectively coupled to the cabinet face. The attachment assembly includes an attacher body in the form of a spring clamp that provides pressure on a front and a back of the cabinet face when the attachment assembly is coupled to the cabinet face. The locking assembly is coupled to the attachment assembly. The locking assembly is selectively movable between a locked position, when the moving component is inhibited from moving relative to the cabinet face, and an unlocked position, when the moving component can be freely moved relative to the cabinet face.

In some embodiments, the attacher body includes a first arm that provides pressure on the back of the cabinet face when the attachment assembly is coupled to the cabinet face, and a second arm that provides pressure on the front of the cabinet face when the attachment assembly is coupled to the cabinet face, the second arm being flexibly coupled to the first arm. Additionally, the attacher body can further include an attacher base that extends between the first arm and the second arm, and flexibly couples the first arm and the second arm to one another.

In certain embodiments, the attacher body is movable between a relaxed position, when the attachment assembly is not coupled to the cabinet face and no pressure is applied to the first arm and the second arm, and a clamping position, when the attachment assembly is coupled to the cabinet face. Further, in some such embodiments, when the attacher body is in the relaxed position, a minimum arm spacing between the first arm and the second arm is less than a face width of the cabinet face to which the attachment assembly is configured to be attached.

Additionally, in some embodiments, the attachment assembly further includes an attacher aligner that is coupled to the attacher body, the attacher aligner being configured to align the attachment assembly relative to the cabinet face. In certain embodiments, the attacher aligner is positioned about the attacher base and a portion of the first arm and the second arm.

Further, in certain embodiments, the locking assembly is adjustably coupled to the attachment assembly. In some such embodiments, the locking assembly includes a transverse member that is adjustably coupled to the attachment assembly, and a pivoting member that is pivotally secured to the transverse member, the pivoting member pivoting relative to the transverse member between a first position in which the pivoting member inhibits large scale movement of the moving component relative to the cabinet body, and a second position in which the pivoting member allows for large scale movement of the moving component relative to the cabinet body. Moreover, in some such embodiments, the pivoting member includes an activator mechanism that is selectively movable between an engaged position when the activator mechanism engages the transverse member to inhibit movement between the first position and the second position, and a disengaged position when the activator mechanism does not engage the transverse member and the pivoting member can pivot relative to the transverse member between the first position and the second position. In such embodiments, movement of the activator mechanism between the engaged position and the disengaged position can include a purely rotational movement of the activator mechanism.

In some embodiments, at least a portion of the latch assembly is formed from molded plastic.

Additionally, the present invention is further directed toward a latch assembly for use with a cabinet that includes a cabinet body having a cabinet face and a moving component that is configured to move relative to the cabinet face, the latch assembly including (i) an attachment assembly that is selectively coupled to the cabinet face, the attachment assembly including an attacher body having a first arm that provides pressure on a back of the cabinet face when the attachment assembly is coupled to the cabinet face, a second arm that provides pressure on the front of the cabinet face when the attachment assembly is coupled to the cabinet face, and an attacher base that extends between the first arm and the second arm, and flexibly couples the first arm and the second arm to one another; and (ii) a locking assembly that is coupled to the attachment assembly, the locking assembly being selectively movable between a locked position, when the moving component is inhibited from moving relative to the cabinet face, and an unlocked position, when the moving component can be freely moved relative to the cabinet face.

Further, the present invention is also directed toward a latch assembly for use with a cabinet that includes a cabinet body having a cabinet face and a moving component that is configured to move relative to the cabinet face, the latch assembly including (A) an attachment assembly that is selectively coupled to the cabinet face, the attachment assembly including (i) an attacher body in the form of a spring clamp having a first arm that provides pressure on a back of the cabinet face when the attachment assembly is coupled to the cabinet face, a second arm that provides pressure on the front of the cabinet face when the attachment assembly is coupled to the cabinet face, and an attacher base that extends between the first arm and the second arm, and flexibly couples the first arm and the second arm to one another; and (ii) an attacher aligner that is coupled to the attacher body, the attacher aligner being configured to align the attachment assembly relative to the cabinet face; and (B) a locking assembly that is adjustably coupled to the attachment assembly, the locking assembly being selectively movable between a locked position, when the moving component is inhibited from moving relative to the cabinet face, and an unlocked position, when the moving component can be freely moved relative to the cabinet face; wherein the attacher body is movable between a relaxed position, when the attachment assembly is not coupled to the cabinet face and no pressure is applied to the first arm and the second arm, and a clamping position, when the attachment assembly is coupled to the cabinet face; and wherein when the attacher body is in the relaxed position, a minimum arm spacing between the first arm and the second arm is less than a face width of the cabinet face to which the attachment assembly is configured to be attached.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Embodiments of the present invention are described herein in the context of a secure latch assembly (sometimes referred to herein simply as a "latch assembly") for use with drawers and doors of cabinets. As provided herein, in various embodiments, the latch assembly can be quickly and easily moved between a locked position, where the drawers and doors of the cabinets cannot be opened and accessed, and an unlocked position, where the drawers and doors of the cabinets can be opened and accessed. More particularly, embodiments of the latch assembly of the present invention are configured to overcome the various drawbacks of generally available safety latches, such that they are relatively low-cost, easy to install and operate, have limited pre-travel to minimize potential finger pinching issues, and do not mar or damage the cabinets to which they are secured.

Those of ordinary skill in the art will realize that the following detailed description of the present invention is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application-related and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 1A:
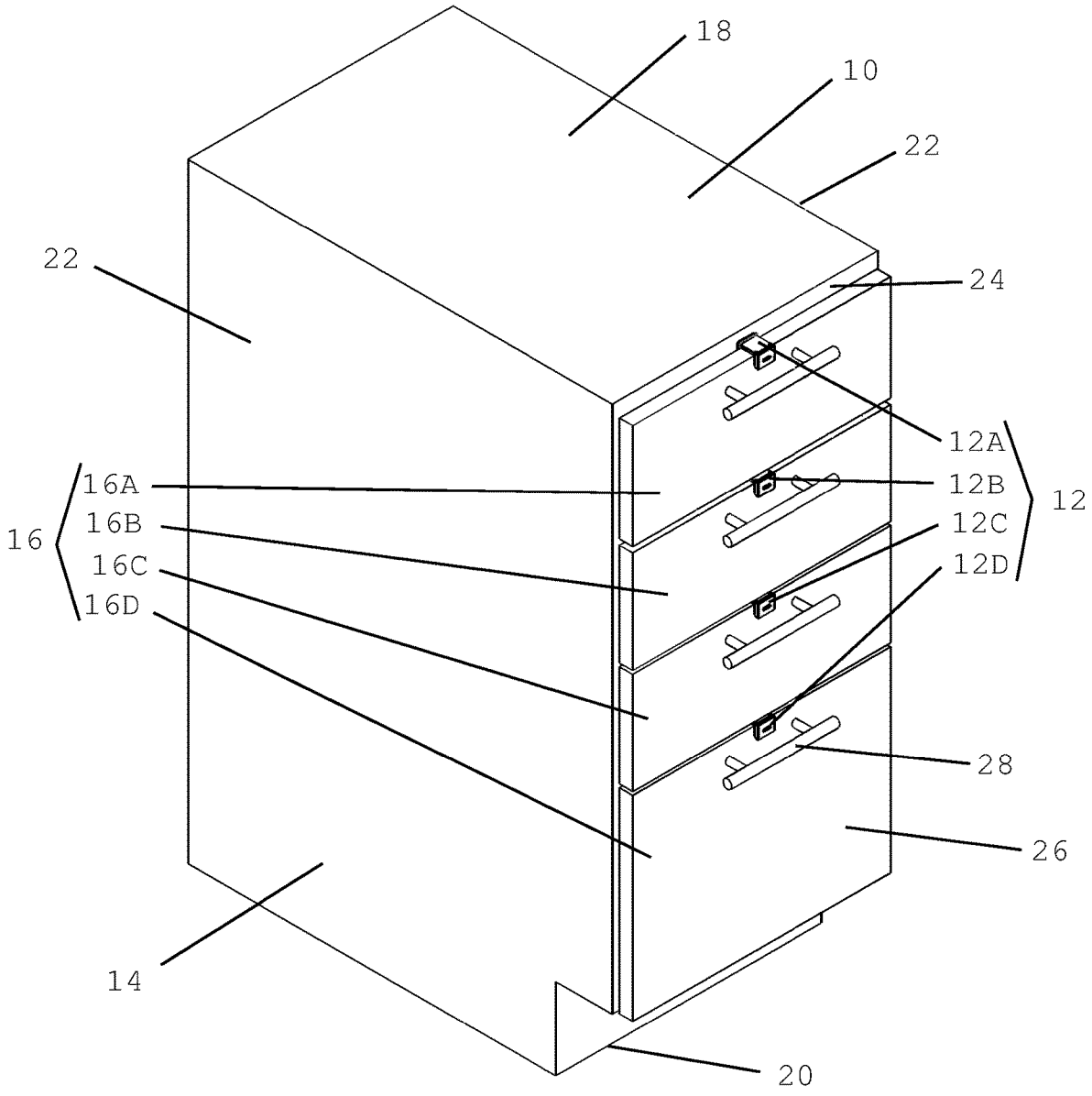
FIG. 1A is a perspective view illustration of a cabinet and a plurality of latch assemblies having features of the present invention, with each of the latch assemblies shown in a locked position.

FIG. 1A is a perspective view of a cabinet 10 and a plurality of latch assemblies 12 having features of the present invention, with each of the latch assemblies 12 being shown in a locked position. As illustrated, the cabinet 10 includes a cabinet body 14 and one or more drawers 16. More particularly, in this embodiment, the cabinet 10 includes four drawers 16, i.e. a first drawer 16A, a second drawer 16B, a third drawer 16C and a fourth drawer 16D, that are vertically arranged relative to one another. Alternatively, the cabinet 10 can include greater than four or fewer than four drawers 16 and/or the drawers 16 can have a different positional relationship relative to one another. Additionally and/or alternatively, the cabinet 10 can include one or more doors 30C (see, for example, the cabinet 10C as illustrated in FIG. 1C). As utilized herein, the drawers 16 and/or the doors 30C of the cabinet 10 or 10C can be referred to generically as "moving components".

As provided herein, the latch assemblies 12 of the present invention are uniquely designed so that they can be quickly and easily installed on and/or removed from a drawer 16 or door 30C of the cabinet 10 or 10C, and the latch assemblies 12 can be used without causing any unnecessary or unwanted damage to the cabinet 10 or 10C. Additionally, the latch assemblies 12 limit the pre-travel of the drawer 16 or door 30C, i.e. the moving component, of the cabinet 10 or 10C when the latch assemblies 12 are in the locked position, thereby inhibiting any potential pinching of fingers of babies and/or young children. Further, the latch assemblies 12 are visible to the opener of the drawer 16 or door 30C. This provides an indication to the opener of the drawer 16 or door 30C that the latch assembly 12 must be unlatched prior to opening.

As shown in FIG. 1A, the drawers 16 are positioned substantially within the cabinet body 14, i.e. the drawers 16 are closed. Further, as illustrated, a separate latch assembly 12 selectively engages and/or is operative relative to a top of each drawer 16. In particular, a first latch assembly 12A selectively engages and/or is operative relative to the top of the first drawer 16A, a second latch assembly 12B selectively engages and/or is operative relative to the top of the second drawer 16B, a third latch assembly 12C selectively engages and/or is operative relative to the top of the third drawer 16C, and a fourth latch assembly 12D selectively engages and/or is operative relative to the top of the fourth drawer 16D. Alternatively, one or more of the latch assemblies 12A-12D can selectively engage and/or be operative relative to a bottom or one of the sides of the drawers 16A-16D. Further, although the latch assemblies 12A-12D are illustrated substantially centrally located along the top of the respective drawers 16A-16D, it is appreciated that the latch assemblies 12A-12D can be located in any suitable position along the top, sides or bottom of the respective drawers 16A-16D.

It should be noted that any of the drawers 16A-16D can be equally referred to as the "first drawer", the "second drawer", the "third drawer" and/or the "fourth drawer". Moreover, any of the latch assemblies 12A-12D can be equally referred to as the "first latch assembly", the "second latch assembly", the "third latch assembly" and/or the "fourth latch assembly".

The cabinet body 14 includes a cabinet top 18, a cabinet bottom 20, a pair of opposed cabinet sides 22 and a cabinet face 24. The cabinet face 24 receives the drawers 16A-16D and effectively provides a frame around at least a portion of each of the drawers 16A-16D. In this embodiment, the cabinet face 24 (i) extends substantially from the cabinet top 18 to near the cabinet bottom 20 on either side of the drawers 16A-16D; and (ii) extends from one cabinet side 22 to the other cabinet side 22 above the first drawer 16A, between adjacent drawers 16A-16D, and below the fourth drawer 16D. With this design, the latch assembly 12A-12D can selectively engage and/or be operative relative to the top, the bottom or possibly either side of the drawers 16A-16D.

Each drawer 16A-16D includes a drawer body (not illustrated), a drawer face 26, and a handle 28. The drawer body provides a storage area for storing items as desired. When the drawer 16A-16D is closed, as illustrated in FIG. 1A, the drawer body is positioned substantially within the cabinet body 14. Conversely, when the drawer 16A-16D is open, items can be easily positioned within and/or removed from the drawer 16A-16D. The drawer face 26 faces outwardly away from the drawer body and away from the cabinet body 14. The handle 28 is secured to the drawer face 26 to facilitate the opening and closing of the drawer 16A-16D. Alternatively, each drawer 16A-16D can be designed without a handle 28, and the drawer 16A-16D can be opened in another suitable manner.

Figure 1B:
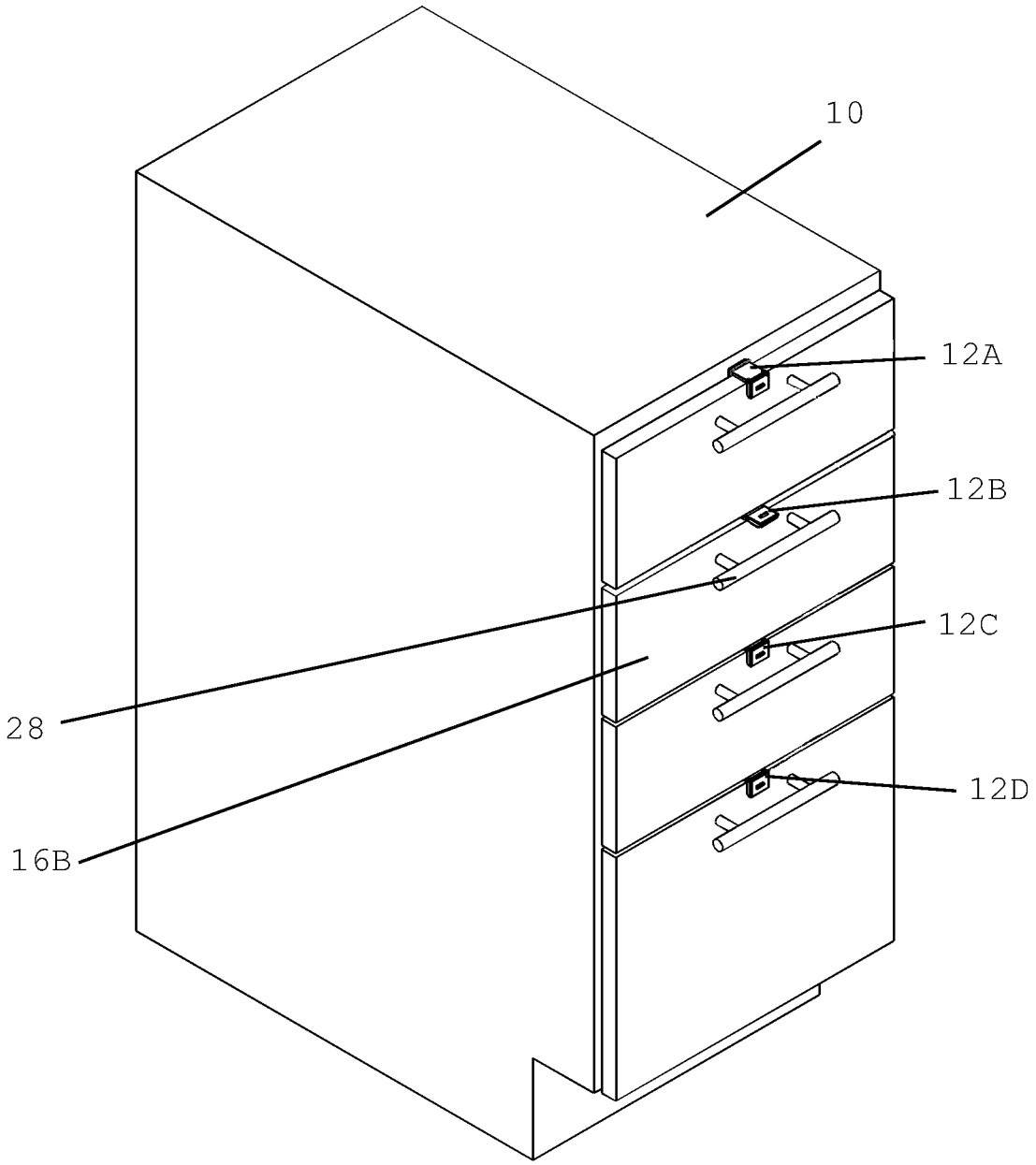
FIG. 1B is a perspective view illustration of the cabinet and the plurality of latch assemblies illustrated in FIG. 1A, with one of the latch assemblies shown in an unlocked position.
Figure 1C:
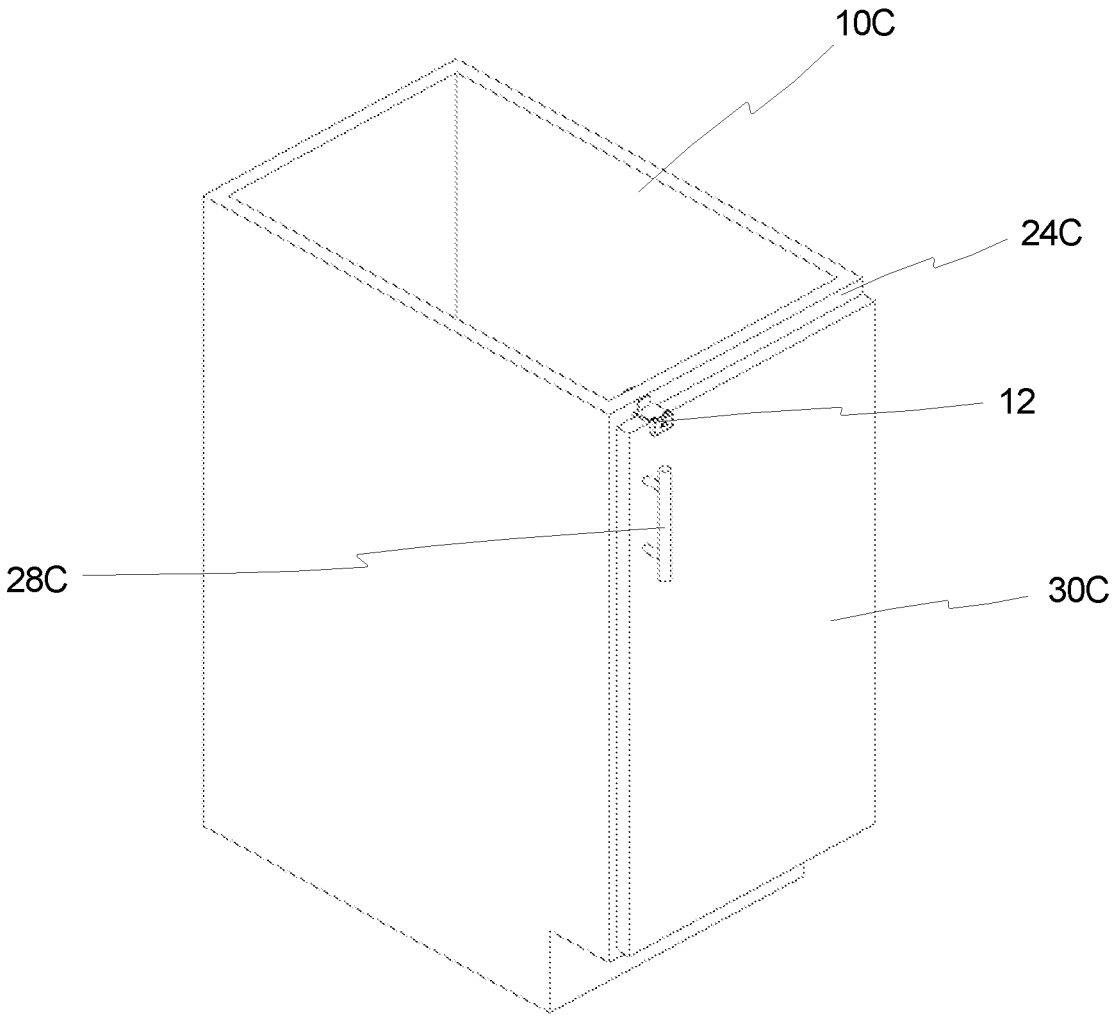
FIG. 1C is a perspective view illustration of another cabinet and the latch assembly illustrated in FIG. 1A.

Additionally, as will be illustrated and described in detail herein, the latch assembly 12 is designed so that the latch assembly 12 can be quickly and easily moved from the locked position (as illustrated in FIG. 1A) to an unlocked position (as the second latch assembly 12B is illustrated in FIG. 1B). When the latch assembly 12 is in the locked position, the drawer 16 or door 30C is inhibited from being opened, e.g., by pulling on the handle 28. Stated another way, when the latch assembly 12 is in the locked position, the latch assembly 12 inhibits the drawer 16 or door 30C from other than slight movement relative to the cabinet body 14, i.e. the latch assembly 12 inhibits large scale movement and/or substantially complete opening of the drawer 16 or door 30C relative to the cabinet body 14. Conversely, when the latch assembly 12 is in the unlocked position, the drawer 16 or door 30C can easily be opened, e.g., by simply pulling on the handle 28. Stated another way, when the latch assembly 12 is in the unlocked position, the latch assembly 12 allows for large scale movement and/or substantially complete opening of the drawer 16 or door 30C relative to the cabinet body 14.

Further, depending on the particular style and/or design of the cabinet 10, the drawer 16 or door 30C may be able to be moved slightly, i.e. with limited pre-travel, when the latch assembly 12 is in the locked position, e.g., in a cabinet that includes a bevel around the perimeter. However, even with such cabinets, the allowable movement of the drawer 16 or door 30C would be less than the thickness of the drawer 16 or door 30C, thereby substantially reducing the risk of babies or young children slamming fingers between the drawer 16 or door 30C and the cabinet face 24C.

In different embodiments, the latch assembly 12 can be used for inhibiting children from accessing kitchen and bathroom cabinet drawers and doors. However, the latch assembly 12 may also be used in dressers, marine cabinets, and motor home cabinets. For example, in marine cabinets and motor home applications, it is desirable to keep cabinet drawers and doors from opening while underway.

FIG. 1B is perspective view of the cabinet 10 and the plurality of latch assemblies 12A-12D illustrated in FIG. 1A, with one of the latch assemblies 12A-12D, i.e. the second latch assembly 12B that engages the second drawer 16B, in the unlocked position. With the second latch assembly 12B in the unlocked position, the second drawer 16B can easily be opened merely by pulling on the handle 28.

FIG. 1C is a perspective view of another cabinet 10C and a latch assembly 12 as illustrated in FIG. 1A. In particular, FIG. 1C illustrates the cabinet 10C including a door 30C that is secured to the cabinet face 24C of the cabinet 10C. Alternatively, the cabinet 10C can include more than one door and/or the cabinet 10C can also include one or more drawers.

As illustrated, the latch assembly 12 selectively engages a top of the door 30C. As shown in FIG. 1C, the latch assembly 12 can be positioned to selectively engage the top of the door 30C toward a side of the door 30C away from the hinges (not illustrated) to provide a stronger locking or latching action for the door 30C and/or to better limit any pre-travel for the door 30C relative to the cabinet 10C. Alternatively, the latch assembly 12 can selectively engage a bottom of the door 30C or the latch assembly 12 can possibly selectively engage a side of the door 30C, i.e. preferably away from the hinges and toward the handle 28C. Further, as illustrated, the latch assembly 12 is in the locked position, thereby inhibiting the door 30C from being opened e.g., by simply pulling on the handle 28C. In certain alternative embodiments, the door 30C can be designed without a handle 28C, and the door 30C can be opened utilizing another means.

Figure 2A:
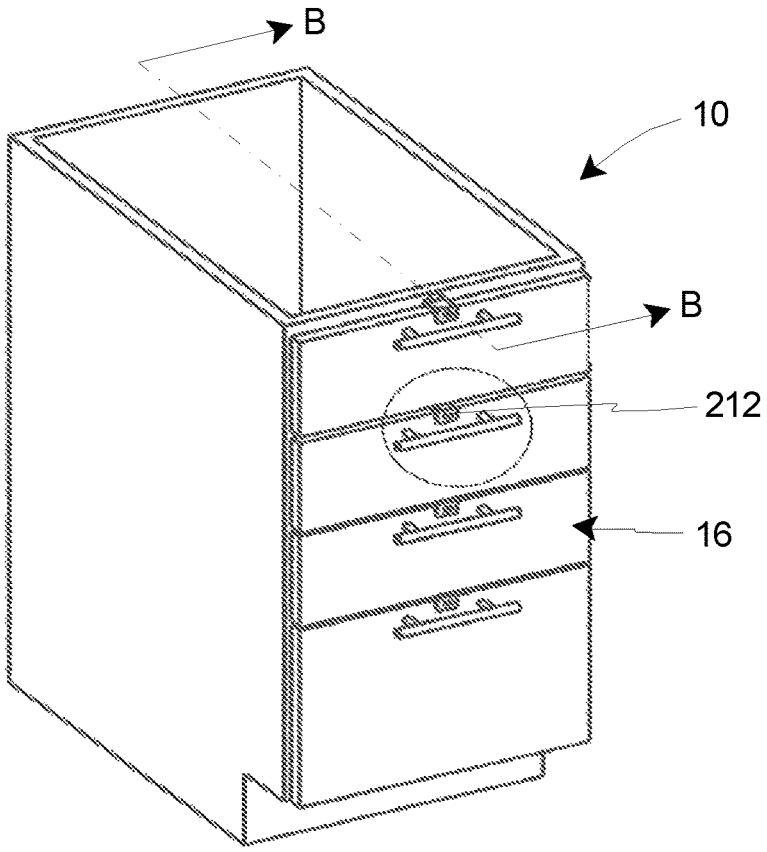
FIG. 2A is a perspective view illustration of a portion of the cabinet and an embodiment of the latch assembly, the latch assembly being shown in the locked position.

FIG. 2A is a perspective view illustration of a portion of the cabinet 10 and an embodiment of the latch assembly 212. More particularly, as shown in FIG. 2A, a separate latch assembly 212 is shown as being selectively attached to and/or operative relative to each of the drawers 16 of the cabinet 10. Further, in FIG. 2A, each latch assembly 212 is being shown in the locked position.

Figure 2B:
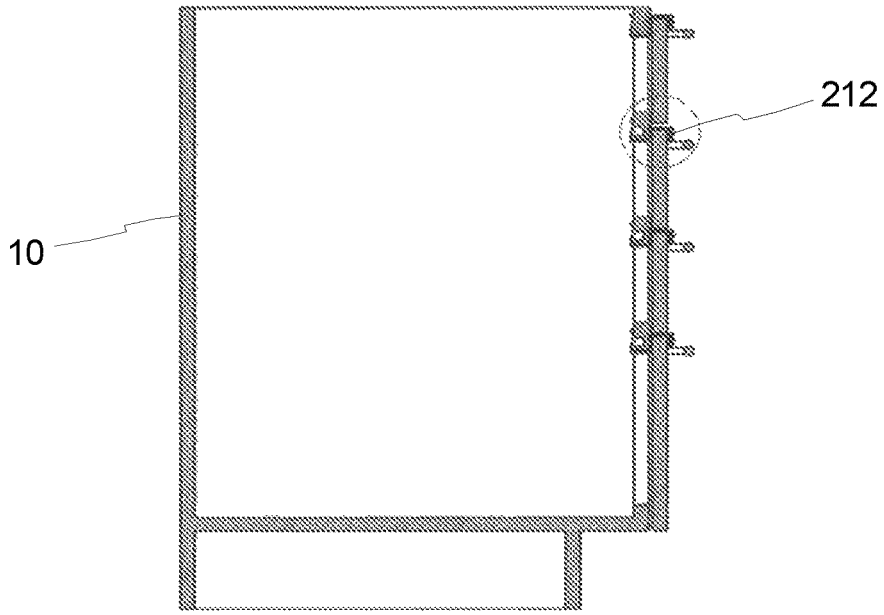
FIG. 2B is a sectional view illustration of the portion of the cabinet and the latch assembly taken on line B-B in FIG. 2A.

FIG. 2B is a sectional view illustration of the portion of the cabinet 10 and the latch assembly 212 taken on line B-B in FIG. 2A. Additionally, in FIG. 2B, each latch assembly 212 is again being shown in the locked position.

Figure 2C:
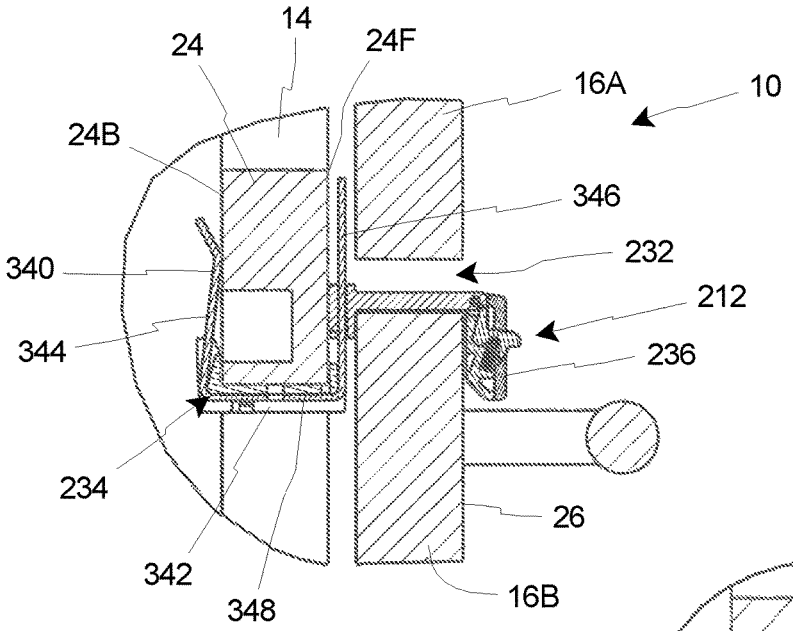
FIG. 2C is an enlarged view illustration of a portion of the sectional view illustration of the portion of the cabinet and the latch assembly in FIG. 2B.

FIG. 2C is an enlarged view illustration of a portion of the sectional view illustration of the portion of the cabinet 10 and the latch assembly 212 in FIG. 2B. In particular, FIG. 2C illustrates a portion of the first drawer 16A, a portion of the second drawer 16B, a portion of the cabinet body 14, and the latch assembly 212. As shown, the latch assembly 212 selectively engages and/or is operative relative to the second drawer 16B. Further, the latch assembly 212 is in the locked position so that the second drawer 16B cannot readily be opened without otherwise moving the latch assembly 212 to the unlocked position. It should be noted that although FIG. 2C illustrates the latch assembly 212 selectively engaging and/or being operative relative to a drawer, i.e. to the second drawer 16B, the latch assembly 212 can equally selectively engage and/or be operative relative to a door 30C (illustrated in FIG. 1C) of the cabinet 10C (illustrated in FIG. 1C).

As illustrated in FIG. 2C, the cabinet body 14 includes the cabinet face 24, with at least a portion of the cabinet face 24 positioned substantially between and/or adjacent to the drawers 16A, 16B so as to allow a certain amount of spacing between adjacent drawers 16A, 16B. The cabinet face 24 faces generally outward away from the rest of the cabinet body 14 in the same direction as the drawers 16A, 16B. For example, in one embodiment, the cabinet 10 can include a gap 232 of approximately three-sixteenths (3/16) inches between adjacent drawers 16A, 16B. Alternatively, the gap 232 between adjacent drawers 16A, 16B can be greater than or less than three-sixteenths inches.

The design of the latch assembly 212 can be varied to suit the specific requirements of the cabinet 10. In the embodiment illustrated in FIG. 2C, the latch assembly 212 includes an attachment assembly 234, and a locking assembly 236 that is adjustably coupled to the attachment assembly 234. Alternatively, in certain embodiments, the latch assembly 212 can include more components than what is specifically illustrated and described in relation to FIG. 2C. For example, in some such alternative embodiments, the latch assembly 212 can incorporate the use of a separate adjustment assembly for further facilitating the adjustable coupling between the attachment assembly 234 and the locking assembly 236.

As an overview, the latch assembly 212 of the present invention incorporates a design which allows implementation using a wide range of materials, including molded plastic and suitable metallic materials, and requires only a small number of fasteners in the installation and assembly of the latch assembly 212. Additionally, the present invention further provides a method for retaining and adjusting the latch assembly 212 based on the cabinets available or currently in use which have a cabinet face 24 and a minimum spacing between drawers 16A, 16B and/or doors 30C (illustrated in FIG. 1C).

As described in detail herein below, the locking features of the latch assembly 212 of the present invention utilize tensile and compressive properties of a given material leading to a larger selection of materials, fabrication methods, and corresponding cost. The lock itself is rotatable within a rotatable member, and is used to keep the rotatable member open when access to the contents of the cabinet 10 is needed or desired, but also improves the locking capability of cabinet drawers 16A, 16B and doors 30C that have a beveled edge around the perimeter. It is appreciated that in some embodiments, the pre-travel can be increased slightly, e.g., with a beveled cabinet drawer or door.

Additionally, the large varying thickness of cabinet bumpers (not shown) led to utilization of what is believed the largest thickness of a sound dampening type for the present invention. The present invention therefore works with many cabinets currently in use or available in the market place which have bumpers of any thickness less than and up to the believed largest available. While the latch assembly 212 is installed on a given drawer 16A, 16B or door 30C, the pre-existing bumpers are unusable, i.e., the present invention features create a new temporary bumper.

As described herein, the present invention incorporates the attachment assembly 234 in the form of a spring clamp for mounting to a given cabinet 10. This utilization removes the need for mounting screws or adhesives plus allows for more implementation possibilities based on space constraints within the cabinet 10, e.g., a laundry cabinet with a deep sink. The spring clamp of the present invention provides enough clamping force between the attachment assembly 234 and the cabinet face 24 to keep it at the proper location relative to the cabinet drawer 16B or door 30C. Additionally, the height adjustment of the locking assembly 236 in the present invention is accomplished simply by moving it up or down on the attachment assembly 234, i.e. the spring clamp, thus giving a large adjustable range based on the requirements of a particular cabinet. This aspect of the present invention further reduces the installation, alignment and removal time as compared to existing safety latch assemblies currently available.

As shown, the attachment assembly 234 is selectively attached to the cabinet 10, e.g., to the cabinet body 14, to selectively couple the locking assembly 236 to the cabinet 10, e.g., to the cabinet body 14. Additionally, the attachment assembly 234, as described herein, selectively couples the locking assembly 236 to the cabinet body 14 without damaging the visible part of the cabinet body 14.

The design of the attachment assembly 234 can be varied to suit the specific requirements of the latch assembly 212 and/or the cabinet 10. In the embodiment illustrated in FIG. 2C, the attachment assembly 234 can be provided in the form of a spring clamp that selectively provides pressure and/or contact on both the front 24F and the back 24B of the cabinet face 24 to selectively couple the locking assembly 236 to the cabinet face 24. Alternatively, the attachment assembly 234 can have a different design.

In this embodiment, the locking assembly 236 is adjustably secured to the attachment assembly 234. The locking assembly 236 provides the operative portion of the latch assembly 212 so that the latch assembly 212 can be quickly and easily moved between the locked position, as illustrated in FIG. 2C, and the unlocked position, as illustrated, for example, in FIG. 4C. As shown, when in the locked position, a portion of the locking assembly 236 engages and/or is positioned in front of the second drawer 16B, i.e. engages and/or is positioned adjacent to the drawer face 26, so that the second drawer 16B is inhibited from being opened. Further, with this design, the locking assembly 236 is easily visible to the user of the cabinet 10. Moreover, the positioning of the portion of the locking assembly 236 so that it engages and/or is positioned adjacent to the drawer face 26 or door face when in the locked position, limits the movement of the drawer 16 or door 30C so as to inhibit the pinching of fingers between the drawer 16 or door 30C and the cabinet face 24.

Additionally, as noted, the attachment assembly 234 and/or the locking assembly 236 can include features that enable the locking assembly 236 to be adjustably secured to the attachment assembly 234. This capability further adjusts the position of the locking assembly 236 relative to the attachment assembly 234 and, thus, adjusts the position of the locking assembly 236 relative to the drawers 16A, 16B and the cabinet body 14. Additionally, this capability adjusts the position of the locking assembly 236 to enable the latch assembly 212 to be used on drawers 16A, 16B or doors 30C of different heights relative to the cabinet face 24. More particularly, with this design, i.e. with the adjustability of the locking assembly 236 relative to the attachment assembly 234, the locking assembly 236 can more effectively maintain the second drawer 16B in a closed position. As shown in FIG. 2C, with such design, a portion of the locking assembly 236 can be positioned to extend across and be positioned very close to the top of the second drawer 16B. In some embodiments, when the latch assembly 212 selectively engages and/or is operative relative to the top of the drawer 16B, the closer the locking assembly 236 is positioned to the top of the drawer 16B, the higher the force required to cause the latch assembly 212 to malfunction.

Further, the adjustability of the locking assembly 236 relative to the attachment assembly 234 enables the latch assembly 212 to be used with a wider range of cabinet styles available on the market, and allows the possibility of mounting the latch assembly 212 on either the top, bottom or side of the particular cabinet drawer 16A, 16B, or the top, bottom or side of a cabinet door 30C.

The various components of the latch assembly 212, i.e. the attachment assembly 234 and the locking assembly 236, will be described in greater detail herein below.

Figure 2D:
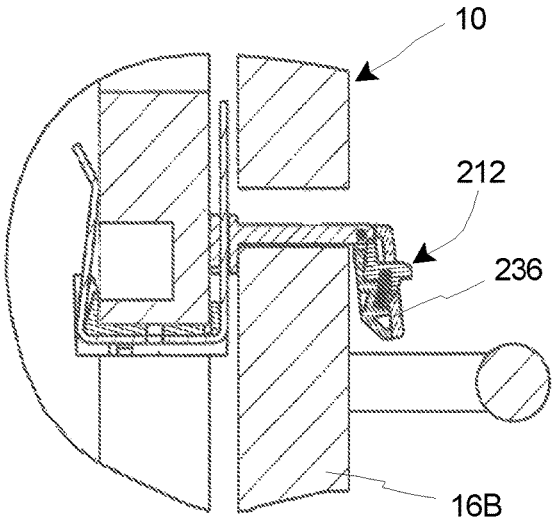
FIG. 2D is an enlarged view illustration of a portion of the sectional view illustration of the portion of the cabinet and the latch assembly in FIG. 2B, the latch assembly being shown in a pre-travel position.

FIG. 2D is another enlarged view illustration of a portion of the sectional view illustration of the portion of the cabinet 10 and the latch assembly 212 in FIG. 2B. However, in FIG. 2D, the latch assembly 212 is now being shown in a pre-travel position. In particular, as shown, the extent of possible pre-travel of the locking assembly 236, i.e. relative to the drawer 16B or door 30C (illustrated in FIG. 1C) to which the latch assembly 212 is secured, is fairly limited, so as to better inhibit any potential pinching of fingers.

Figure 2E:
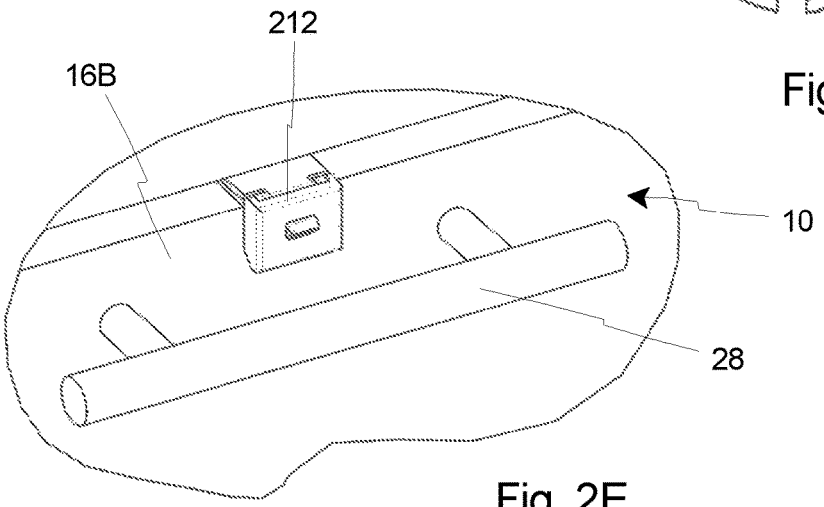
FIG. 2E is an enlarged view illustration of a portion of the cabinet and the latch assembly illustrated in FIG. 2A.

FIG. 2E is an enlarged view illustration of a portion of the cabinet 10 and the latch assembly 212 illustrated in FIG. 2A. More specifically, FIG. 2E illustrates the latch assembly 212 mounted on the second drawer 16B of the cabinet 10, and near the handle 28 of the second drawer 16B.

Figure 3A:
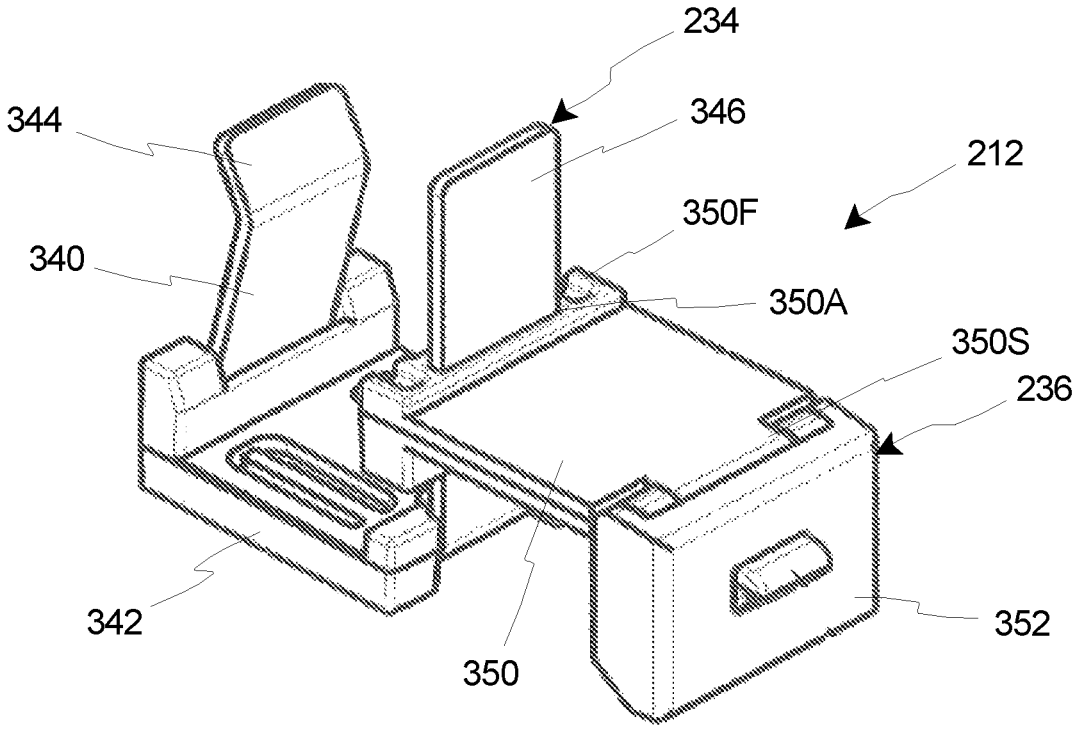
FIG. 3A is a perspective view illustration of the latch assembly illustrated in FIG. 2A, the latch assembly being shown in the locked position.

FIG. 3A is a perspective view illustration of the latch assembly 212 illustrated in FIG. 2A, the latch assembly 212 again being shown in the locked position. More particularly, FIG. 3A illustrates certain features of and the interrelationship between the attachment assembly 234 and the locking assembly 236.

As provided above, the attachment assembly 234 selectively couples the locking assembly 236 to the cabinet body 14 (illustrated, for example, in FIG. 1A). The design of the attachment assembly 234 can be varied to suit the specific design requirements of the latch assembly 212 and/or the cabinet 10 (illustrated in FIG. 1A). In this embodiment, the attachment assembly 234 is provided generally in the form of a spring clamp and includes an attacher body 340, and an attacher cover 342 that is positioned around at least a portion of the attacher body 340.

As illustrated in the embodiment shown in FIG. 3A, the attacher body 340 can be substantially U-shaped and can include a first (inner) arm 344, a second (outer) arm 346, and an attacher base 348 (shown, for example, in FIG. 2C) that extends between the first arm 344 and the second arm 346 to flexibly couple the first arm 344 and the second arm 346 to one another. Additionally, as shown, the attacher cover 342 can be positioned around the attacher base 348 and a portion of each of the first arm 344 and the second arm 346 of the attacher body 340. Alternatively, the attacher body 340 and/or the attacher cover 342 can have a different design or shape than what is illustrated and described herein.

Referring back to FIG. 2C, in one embodiment, the attacher body 340, i.e. the spring clamp, is adapted to be positioned about the portion of the cabinet body 14, i.e. the portion of the cabinet face 24, that is positioned substantially between and/or adjacent to the first drawer 16A and the second drawer 16B. Additionally, as shown in FIG. 2C, with the latch assembly 212 selectively engaging and/or operative relative to the top of the second drawer 16B to selectively maintain the second drawer 16B in the closed position, the attacher body 340 extends underneath the portion of the cabinet face 24 that is positioned substantially between and/or adjacent to the first drawer 16A and the second drawer 16B. Additionally, as shown, when the attachment assembly 234 and/or the attacher body 340 is mounted on and/or secured to the cabinet body 14, i.e. in a clamping position, the first arm 344 of the attacher body 340 provides pressure and/or contact on the back 24B of the cabinet face 24, and the second arm 346 of the attacher body 340 provides pressure and/or contact on the front 24F of the cabinet face 24. It is appreciated that the first arm 344 and the second arm 346 of the attacher body 340 can provide sufficient pressure and/or contact with the back 24B and the front 24F of the cabinet face 24, respectively, to maintain the desired positioning of the latch assembly 212 relative to the drawers 16A, 16B of the cabinet 10, due to the flexibility of the arms 344, 346 relative to one another in the spring clamp design.

Further, as shown in FIG. 2C, the attacher cover 342 can also extend underneath the portion of the cabinet face 24 that is positioned substantially between and/or adjacent to the first drawer 16A and the second drawer 16B, and provide pressure and/or contact on a small portion of both the front 24F and the back 24B of the cabinet face 24. The attacher cover 342 positioned about the attacher base 348 and a portion of each of the arms 344, 346 of the attacher body 340 can also be utilized to properly orient and/or align the attachment assembly 234 relative to the cabinet face 24, i.e. on both the front 24F and the back 24B of the cabinet face 24. As such, the attacher cover 342 can also be referred to generally as an "attacher aligner" or simply as an "aligner".

It is appreciated that in different embodiments, different size attacher bodies 340, e.g., clamp bodies, may be required depending on the size of the cabinet 10 or drawers 16A, 16B or door 30C (illustrated in FIG. 1C).

The attacher body 340, i.e. the first arm 344, the second arm 346 and the attacher base 348, can be made from any suitable materials. For example, in some embodiments, the attacher body 340 can be formed from any spring metal or other suitable metallic materials. In one embodiment, the material has a minimum yield strength of 75000 pounds per square inch. With such design, the attacher body 340 can have sufficient strength properties so as to not fail when a force is applied through the cabinet drawers 16A, 16B or door 30C. Additionally, in such embodiments, the attacher body 340 will not cause any significant damage to any surfaces of the cabinet 10, i.e. especially not any visible surfaces of the cabinet 10, as there is only limited direct contact between the attacher body 340 and the cabinet face 24. Further, or in the alternative, in certain embodiments, it is desired that the attacher body 340 be formed from material soft enough to inhibit scratching or dents to the front 24F and the back 24B of the cabinet face 24, as well as underneath the portion of the cabinet face 24 that is positioned substantially between and/or adjacent to the first drawer 16A and the second drawer 16B. For example, in one non-exclusive alternative embodiment, the attacher body 340 can be formed from molded plastic. Still alternatively, the attacher body 340 can be made of other suitable materials.

Additionally, the attacher cover 342 can be made from any suitable materials. In some embodiments, such as shown in FIG. 2C, the attacher cover 342 can provide a greater amount of the contact between attachment assembly 234 and the cabinet face 24, as compared to the attacher body 340. Thus, in such embodiments, it may be even more important that the attacher cover 342 be formed from material soft enough to inhibit scratching or dents to the front 24F and the back 24B of the cabinet face 24, as well as underneath the portion of the cabinet face 24 that is positioned substantially between and/or adjacent to the first drawer 16A and the second drawer 16B. For example, in certain such embodiments, the attacher cover 342 can be formed from a material that is even softer than the material that is used for the attacher body 340. In one non-exclusive embodiment, the attacher cover 342 can be formed from a molded plastic material, and the attacher body 340 can be formed from a slightly harder material (e.g., suitable metallic materials with greater strength characteristics) than the material used for the attacher cover 342.

As noted, in various embodiments, it is desired that the attacher body 340 and/or the attacher cover be formed from suitable materials so as to inhibit scratching or dents to the front 24F and the back 24B of the cabinet face 24, as well as underneath the portion of the cabinet face 24 that is positioned substantially between and/or adjacent to the first drawer 16A and the second drawer 16B, which may otherwise occur due to the contact between the attacher body 340 and/or attacher cover 342 and the cabinet face 24.

Referring again to FIG. 3A, the features and operation of the locking assembly 236 will now be described in greater detail. As noted, the locking assembly 236 is adjustably secured to the attachment assembly 234 so as to enable the latch assembly 212 to be quickly and easily moved between the locked position and the unlocked position. The design of the locking assembly 236 can be varied to suit the specific design requirements of the latch assembly 212 and/or the cabinet 10. As shown in the embodiment illustrated in FIG. 3A, the locking assembly 236 includes a transverse member 350 and a pivoting member 352. Alternatively, the locking assembly 236 can have another suitable design.

In this embodiment, the transverse member 350 is adjustably secured to and cantilevers substantially perpendicularly away from the attacher body 340, i.e. from the second arm 346 of the attacher body 340. With this design, the transverse member 350 can be selectively coupled to the cabinet 10. Further, when installed, the transverse member 350 is designed to extend substantially along an edge, i.e. along the top, the bottom or possibly a side, of the drawer 16B (illustrated, for example, in FIG. 2C) or door 30C (illustrated in FIG. 1C) of the cabinet 10. Moreover, in some embodiments, the closer the locking assembly 236 is positioned to the edge of the drawer 16B or door 30C, the higher the force required to cause the latch assembly 212 to malfunction.

As illustrated, the transverse member 350 has a substantially square, flat plate-like design and includes a first end 350F, and an opposed second end 350S. Alternatively, the transverse member 350 can have a different shape and/or a different design.

As shown, the first end 350F of the transverse member 350 is adjustably secured to the attacher body 340. More specifically, in this embodiment, the first end 350F of the transverse member 350 includes a slot-shaped aperture 350A that fits over and can be maintained securely in position around the second arm 346 of the attacher body 340. In one embodiment, the fit between the second arm 346 of the attacher body 340 and the aperture 350A of the transverse member 350 can be fairly snug so as to enable a frictional force there between to maintain the desired relative positioning between the second arm 346 and the aperture 350A. Thus, with such design, the transverse member 350 can be moved, e.g., vertically, along and/or relative to the second arm 346 of the attacher body 340 to adjust a desired position, e.g., height, of the transverse member 350 relative to the attacher body 340. More specifically, FIG. 3A illustrates the transverse member 350, and thus the locking assembly 236, at a first position, e.g., height, along and/or relative to the second arm 346 and/or the attacher body 340. Additionally, or in the alternative, the transverse member 350, and thus the locking assembly 236, can be positioned at any other suitable position, e.g., a second position, a third position, a fourth position, etc., along and/or relative to the second arm 346 and/or the attacher body 340. It is appreciated that the specific position chosen for the transverse member 350 relative to the attacher body 340 can be selected so as to fit drawers 16B or doors 30C of different sizes and/or to accommodate different sizes of the cabinet body 14. For example, as shown in FIG. 2A, the transverse member 350 can be secured to the attacher body 340 such that the transverse member 350 is positioned as near to the top of the second drawer 16B as is reasonably possible so that the locking assembly 236 can more effectively maintain the second drawer 16B in the closed position. Additionally, during adjustment of the transverse member 350 along and/or relative to the second arm 346 of the attacher body 340, when attached to the cabinet face 24, the position of the second arm 346 relative to the front 24F of the cabinet face 24 will adjust slightly while the position of the first arm 344 relative to the back 24B of the cabinet face 24 will be substantially unchanged. Alternatively, the transverse member 350 can be adjustably secured to the attacher body 340 in another suitable manner.

Additionally, in this embodiment, the pivoting member 352 is pivotally secured to the transverse member 350 and/or the pivoting member 352 is pivotally coupled to the attachment assembly 234. More particularly, in this embodiment, the pivoting member 352 is pivotally secured to the second end 350S of the transverse member 350. Alternatively, the pivoting member 352 can be pivotally secured to a different portion of the transverse member 350.

Further, the pivoting member 352 is adapted to pivot about a pivot pin 354 (illustrated in FIG. 3E) relative to the transverse member 350 between a first position (as illustrated in FIG. 3A), with the latch assembly 212 in the locked position, and a second position (as illustrated, for example, in FIG. 5A), with the latch assembly 212 in the unlocked position.

As illustrated and described herein, a portion of the pivoting member 352 selectively engages a portion of the transverse member 350 to selectively inhibit the pivoting member 352 from pivoting relative to the transverse member 350. For example, when the pivoting member 352 is in the first position, a portion of the pivoting member 352 engages a portion of the transverse member 350, and the pivoting member 352 is inhibited from pivoting relative to the transverse member 350, i.e. from the first position to the second position. Moreover, when the pivoting member 352 is in the first position, the pivoting member 352 inhibits the drawer 16B or door 30C from other than slight movement relative to the cabinet body 14, i.e. the pivoting member 352 inhibits large scale movement of the drawer 16B or door 30C relative to the cabinet body 14.

Additionally, when the pivoting member 352 is in the second position, a portion of the pivoting member 352 engages a portion of the transverse member 350, and the pivoting member 352 is inhibited from pivoting relative to the transverse member 350, i.e. from the second position to the first position. However, when the pivoting member 352 is in the second position, and thus the latch assembly 212 is in the unlocked position, the pivoting member 352 allows for large scale movement of the drawer 16B or door 30C relative to the cabinet body 14.

It should be noted that the use of the terms "first position" and "second position" is merely for ease of description, and either position can be equally referred to as the first position and/or the second position.

Figure 3B:
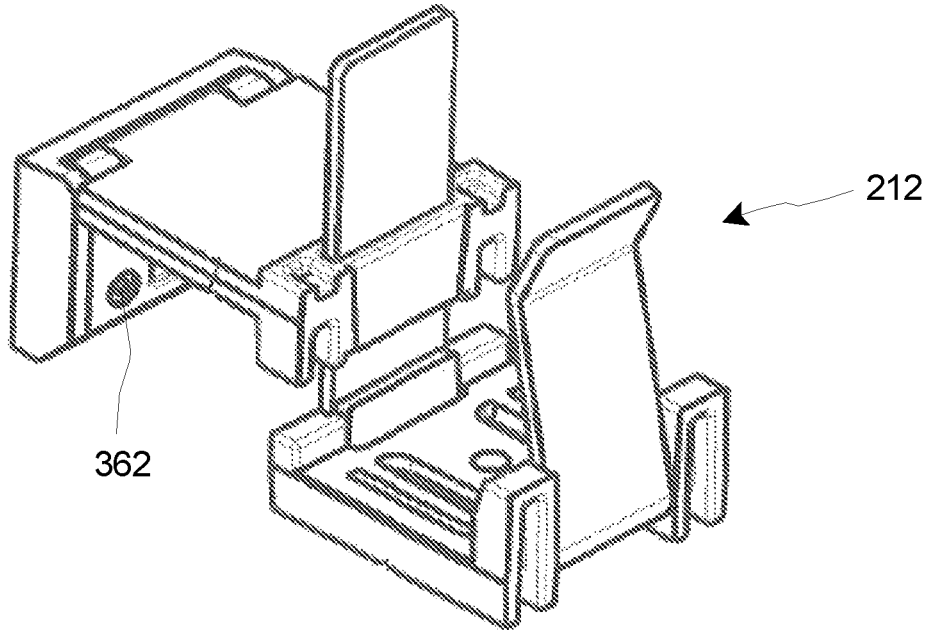
FIG. 3B is another perspective view illustration of the latch assembly illustrated in FIG. 3A.

FIG. 3B is another perspective view illustration of the latch assembly 212 illustrated in FIG. 3A.

Figure 3C:
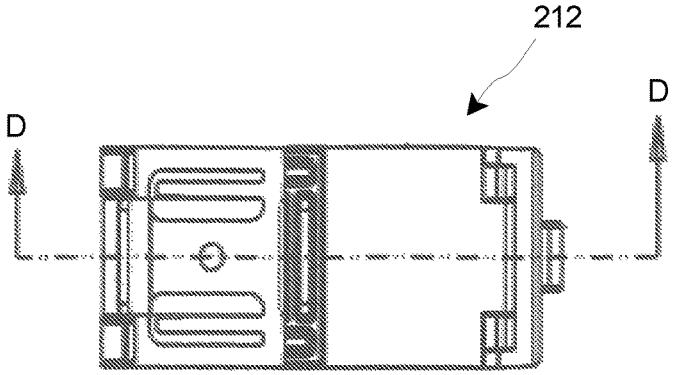
FIG. 3C is a top view illustration of the latch assembly illustrated in FIG. 3A.

FIG. 3C is a top view illustration of the latch assembly 212 illustrated in FIG. 3A.

Figure 3D:
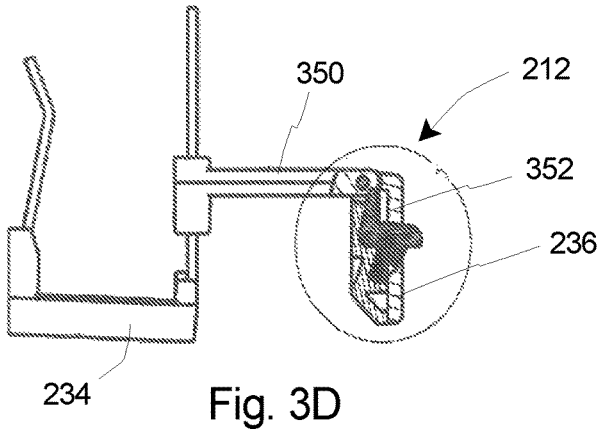
FIG. 3D is a sectional view illustration of the latch assembly taken on line D-D in FIG. 3C.

FIG. 3D is a sectional view illustration of the latch assembly 212 taken on line D-D in FIG. 3C. More particularly, FIG. 3D illustrates the relative orientation and positioning of the attachment assembly 234 and the locking assembly 236 when the latch assembly 212 is in the locked position. Moreover, FIG. 3D illustrates the pivoting member 352 in the first position, with the pivoting member 352 positioned substantially perpendicular to the transverse member 350.

Figure 3E:
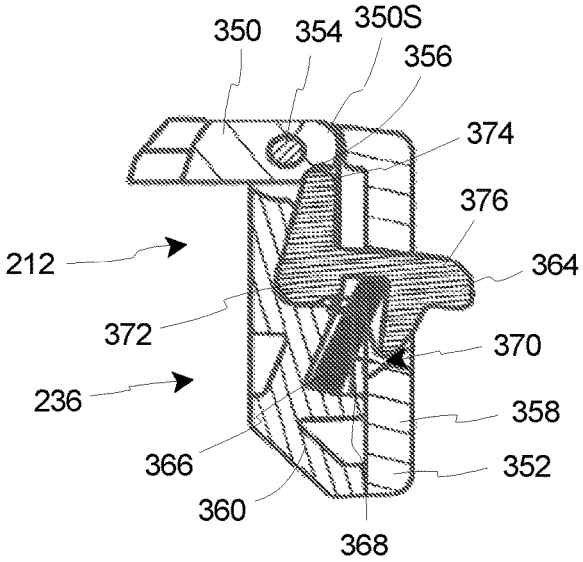
FIG. 3E is an enlarged view illustration of a portion of the sectional view illustration of the latch assembly in FIG. 3D.

FIG. 3E is an enlarged view illustration of a portion of the sectional view illustration of the latch assembly 212 in FIG. 3D. In particular, FIG. 3E is a cross-sectional view of a portion of the locking assembly 236, with the pivoting member 352 in the first position, i.e. the latch assembly 212 is in the locked position. As provided above, when the pivoting member 352 is in the first position, a portion of the pivoting member 352 engages a portion of the transverse member 350, and the pivoting member 352 is inhibited from pivoting relative to the transverse member 350.

In this embodiment, the transverse member 350 of the locking assembly 236 includes a recessed area 356 positioned near the second end 350S. As shown, the recessed area 356 can be a small notch that is formed into the transverse member 350 near the second end 350S. The recessed area 356 is adapted to selectively receive and retain a portion of the pivoting member 352 of the locking assembly 236. Alternatively, the pivoting member 352 can include a recessed area that is adapted to selectively receive and retain a portion of the transverse member 350.

Additionally, as illustrated in this embodiment, the pivoting member 352 includes a face plate 358, a back plate 360, one or more plate attachers 362 (illustrated in FIG. 3B), an activator mechanism 364, and one or more resilient members 366.

As shown in FIG. 3E, the face plate 358 can be a substantially flat plate with a small portion at a top of the face plate 358 that extends inwardly to engage the second end 350S of the transverse member 350. Additionally, the back plate 360 can have a configuration that is adapted to receive at least a portion of the activator mechanism 364 and the one or more resilient members 366. Further, the back plate 360 is secured to the face plate 358 with the one or more plate attachers 362.

As shown, the face plate 358 and the back plate 360 cooperate to define a member cavity 368, with the activator mechanism 364 and the one or more resilient members 366 being positioned substantially within the member cavity 368. Further, the face plate 358 and the back plate 360 cooperate to guide the movement of the activator mechanism 364 within the member cavity 368.

Additionally, the face plate 358 further includes a plate aperture 370, with a portion of the activator mechanism 364 being adapted to extend through the plate aperture 370.

As illustrated in this embodiment, the activator mechanism 364 includes a mechanism body 372 having an end tab 374 and a front tab 376. As illustrated, at least a portion of the mechanism body 372 is positioned within the member cavity 368. Alternatively, the mechanism body 372 can have a different design than what is specifically shown in FIG. 3E.

The end tab 374 extends away from an end of the mechanism body 372, and is selectively positioned within the recessed area 356 that is positioned at or near the second end 350S of the transverse member 350. More particularly, as shown in FIG. 3E, when the pivoting member 352 is in the first position, i.e. when the latch assembly 212 is in the locked position, the end tab 374 is positioned substantially within the recessed area 356.

Further, the front tab 376 cantilevers away from the rest of the mechanism body 372. Moreover, as shown in FIG. 3E, at least a portion of the front tab 376 is adapted to extend through the plate aperture 370. The plate aperture 370 is sized and shaped so as to allow for limited translational and/or rotational movement of the front tab 376, and thus the activator mechanism 364, relative to the face plate 358. In particular, the activator mechanism 364, via the manual movement of the front tab 376 in a translational and/or rotational manner relative to the face plate 358, is selectively movable between an engaged position and a disengaged position. When in the engaged position, the end tab 374 is positioned substantially within the recessed area 356, as shown in FIG. 3E, the latch assembly 212 is in the locked position, and the pivoting member 352 is inhibited from pivoting relative to the transverse member 350. When in the disengaged position, the end tab 374 has been removed from the recessed area 356 and the pivoting member 352 can be pivoted, e.g., by approximately ninety degrees, relative to the transverse member 350, so that the latch assembly 212 is in the unlocked position.

As provided above, the one or more resilient members 366 are positioned substantially within the member cavity 368. Additionally, as shown, the one or more resilient members 366 can be secured to and extend between a portion of the mechanism body 372 of the activator mechanism 364 and the back plate 360 substantially within the member cavity 368. In one embodiment, the one or more resilient members 366 are biased so as to maintain the end tab 374 positioned within the recessed area 356 of the transverse member 350 absent intentional movement of the front tab 376 of the activator mechanism 364 relative to the face plate 358 within the plate aperture 370. With this design, the latch assembly 212 will be inhibited from inadvertently or unintentionally moving from the locked position to the unlocked position.

Further, in one embodiment, as shown, the pivoting member 352 includes only a single resilient member 366. Alternatively, the pivoting member 352 can include more than one resilient member 366.

When the pivoting member 352 is in the first position and the latch assembly 212 is in the locked position, the face plate 358 of the pivoting member 352 is positioned in front of a portion of one of the drawers 16 (illustrated in FIG. 1A) or the door 30C (illustrated in FIG. 1C), e.g., is substantially parallel to the drawer face 26 (illustrated in FIG. 2C), so that the drawer 16 or door 30C is inhibited from being opened.

In one embodiment, at least a portion of the transverse member 350 and the pivoting member 352 can be made of a softer material, e.g., molded plastic, to protect the finish of the drawer 16 or door 30C of the cabinet 10 (illustrated in FIG. 1A) from scratches or dents. However other materials can be utilized. For example, a rigid material (e.g., a metal)

can be used. If a rigid material is used, the contact surfaces of the transverse member 350 and the pivoting member 352 can be covered with a felt or other resilient material that will protect the finish of the drawer 16 or door 30C of the cabinet 10.

Figure 3F:
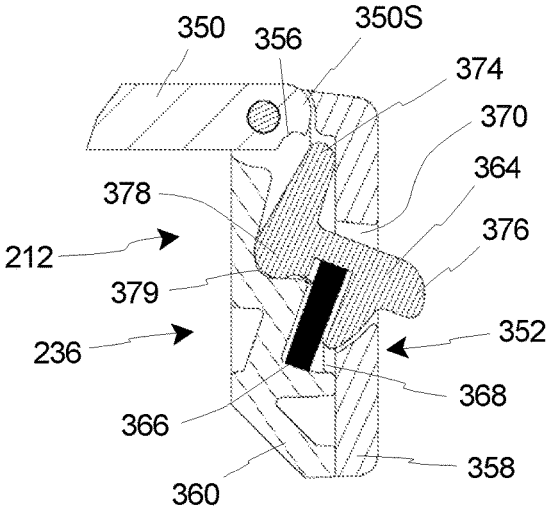
FIG. 3F is another enlarged view illustration of a portion of the sectional view illustration of the latch assembly.

FIG. 3F is another enlarged view illustration of a portion of the sectional view illustration of the latch assembly 212. More specifically, FIG. 3F illustrates the locking assembly 236 with the activator mechanism 364 having been moved to the disengaged position. In particular, the front tab 376 of the activator mechanism 364 has been manually moved in a translational and/or rotational manner relative to the face plate 358 and/or within the plate aperture 370, such that the end tab 374 has been removed from the recessed area 356 at or near the second end 350S of the transverse member 350. Additionally, as shown, during movement from the engaged position to the disengaged position, the one or more resilient members 366 have been compressed within the member cavity 368. It is appreciated that with the activator mechanism 364 now in the disengaged position, the pivoting member 352 can now be pivoted, e.g., by approximately ninety degrees, relative to the transverse member 350, so that the latch assembly 212 is in the unlocked position.

In certain non-exclusive embodiments, the movement of the activator mechanism 364 relative to the face plate 358 when moving between the engaged position and the disengaged position can include a purely rotational movement of the activator mechanism 364 relative to the face plate 358. For example, as shown in FIG. 3F, when moving from the engaged position to the disengaged position, the activator mechanism 364, via movement of the front tab 376, can be rotated about rotational pin member 378 of the activator mechanism 364. Additionally, as shown, the rotational pin member 378 can be constrained to move only in a rotational manner by its positioning within a notch 379 formed into the back plate 360 of the pivoting member 352.

It is appreciated that with the design of the locking assembly 236 as described in detail herein, the movement between the engaged position and the disengaged position, as well as the movement between the locked position and the unlocked position, has been greatly simplified, thereby enabling the use of softer materials such as molded plastic. Moreover, as such, the ability to inhibit marring, scratching, denting, etc. of the surfaces of the cabinet 10 (illustrated in FIG. 2A) has been greatly enhanced.

Figure 3G:
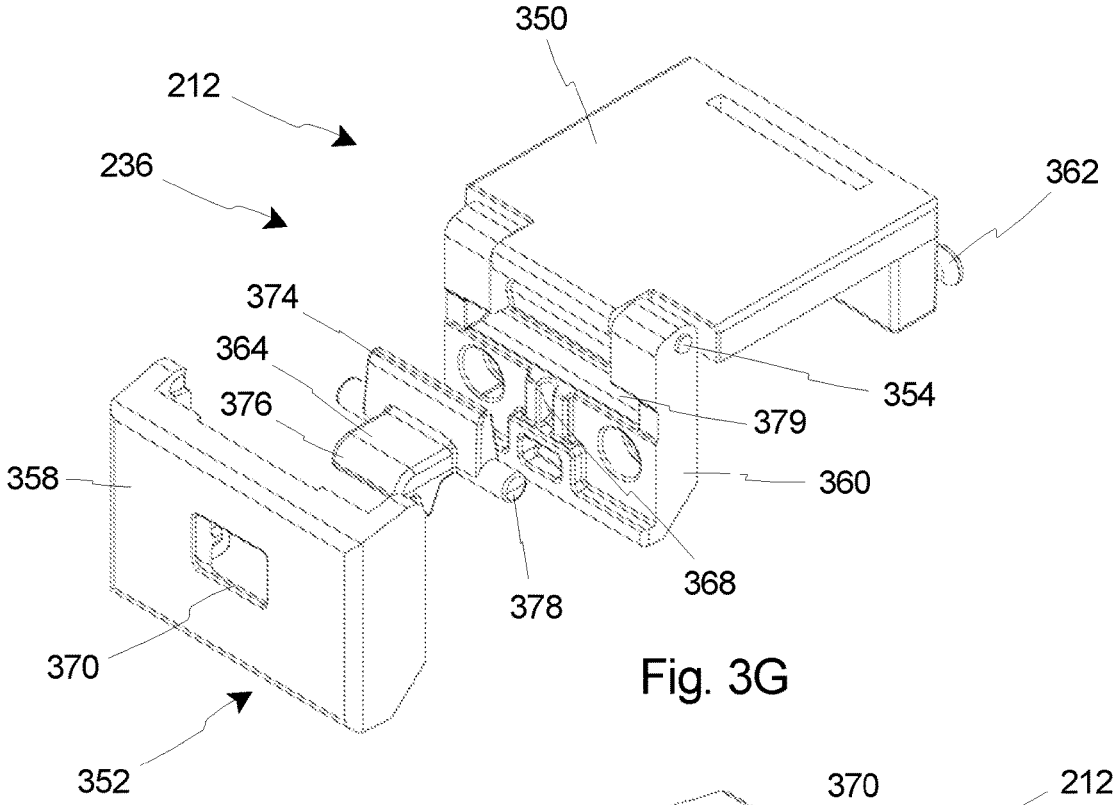
FIG. 3G is a partially exploded front perspective view of a portion of the latch assembly illustrated in FIG. 2A.
Figure 3H:
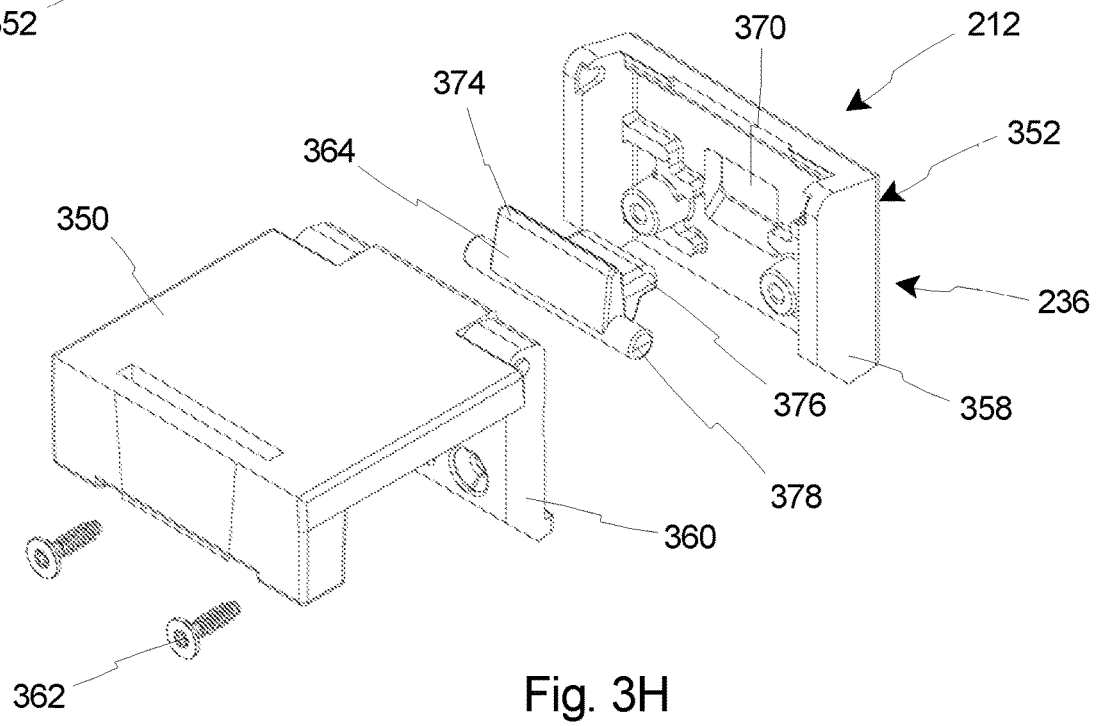
FIG. 3H is a partially exploded rear perspective view of the portion of the latch assembly illustrated in FIG. 3G.

FIG. 3G is a partially exploded front perspective view of a portion of the latch assembly 212 illustrated in FIG. 2A. Additionally, FIG. 3H is a partially exploded rear perspective view of the portion of the latch assembly 212 illustrated in FIG. 3G. In particular, FIGS. 3G and 3H more clearly illustrate various components of the locking assembly 236. For example, FIG. 3G illustrates the transverse member 350, with the back plate 360 of the pivoting member 352 being pivotally coupled to the transverse member 350 via pivot pin 354. Additionally, these Figures show the plate aperture 370 formed into the front plate 358. Further, also shown are the plate attachers 362 for attaching the front plate 358 and the back plate 360 to one another.

FIGS. 3G and 3H further more clearly illustrate features of the activator mechanism 364, such as the end tab 374, the front tab 376, and the rotational pin member 378. FIG. 3G also more clearly shows the notch 379 formed into the back plate 360 that is configured to receive and guide the rotational movement of the rotational pin member 378.

Additionally, FIG. 3G also shows the portion of the member cavity 368 that is specifically configured to receive the one or more resilient members 366 (illustrated in FIG. 3E).

Figure 4A:
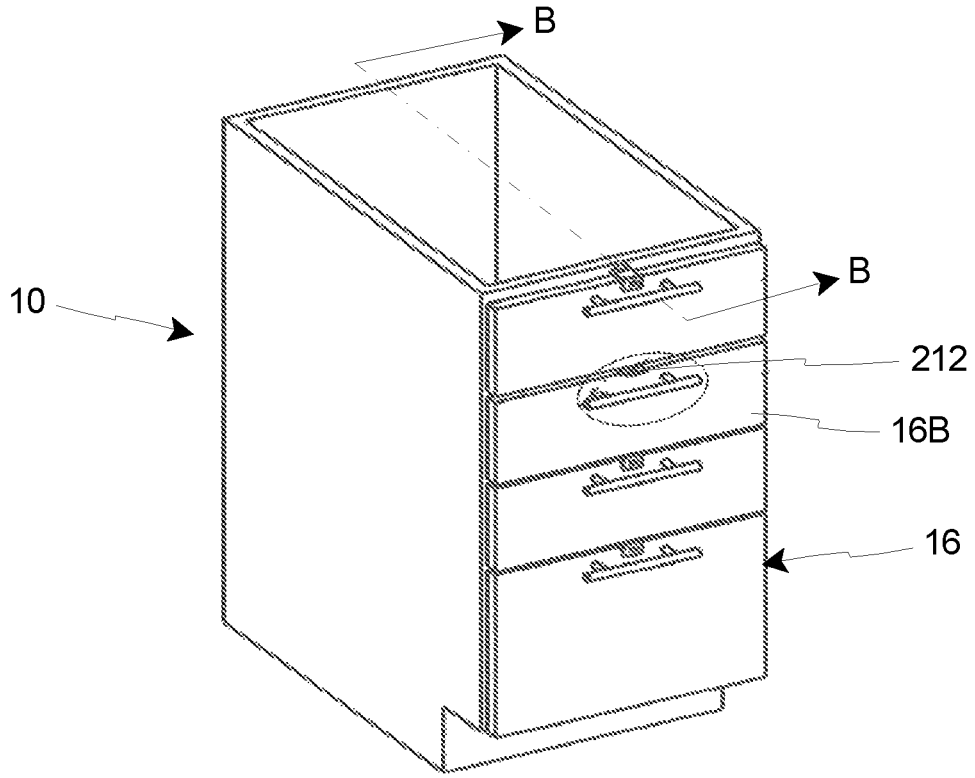
FIG. 4A is a perspective view illustration of a portion of the cabinet and the latch assembly illustrated in FIG. 2A, the latch assembly being shown in the unlocked position.

FIG. 4A is a perspective view illustration of a portion of the cabinet 10 and the latch assembly 212 illustrated in FIG. 2A. More particularly, as shown in FIG. 4A, a separate latch assembly 212 is shown as being selectively attached to and/or operative relative to each of the drawers 16 of the cabinet 10. Further, in FIG. 4A, the latch assembly 212 attached to and/or operative relative to the second drawer 16B is being shown in the unlocked position.

Figure 4B:
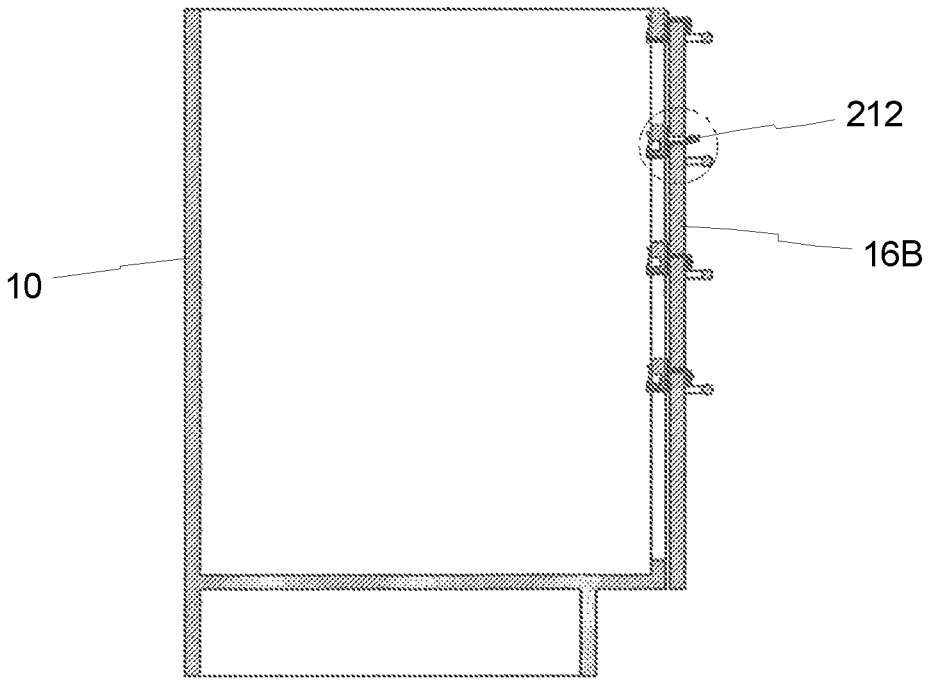
FIG. 4B is a sectional view illustration of the portion of the cabinet and the latch assembly taken on line B-B in FIG. 4A.

FIG. 4B is a sectional view illustration of the portion of the cabinet 10 and the latch assembly 212 taken on line B-B in FIG. 4A. Additionally, in FIG. 4B, the latch assembly 212 attached to and/or operative relative to the second drawer 16B is again being shown in the unlocked position.

Figure 4C:
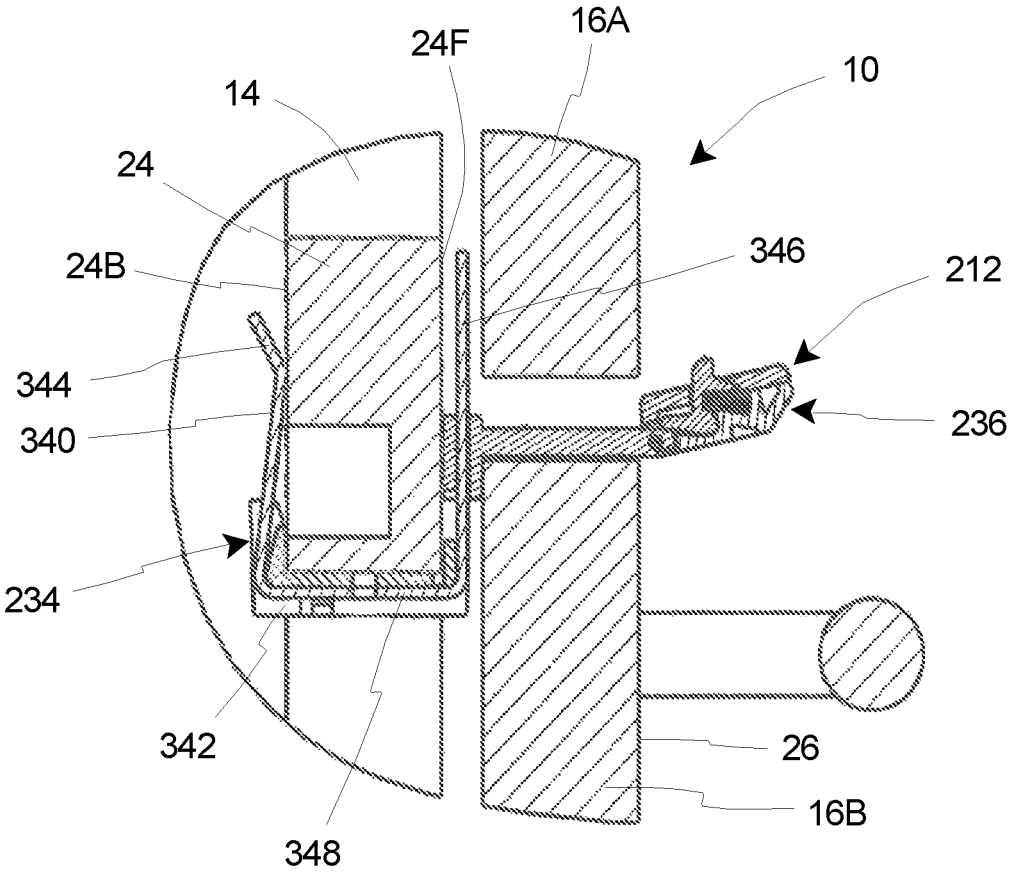
FIG. 4C is an enlarged view illustration of a portion of the sectional view illustration of the portion of the cabinet and the latch assembly in FIG. 4B.

FIG. 4C is an enlarged view illustration of a portion of the sectional view illustration of the portion of the cabinet 10 and the latch assembly 212 in FIG. 4B. In particular, FIG. 4C illustrates a portion of the first drawer 16A, a portion of the second drawer 16B, a portion of the cabinet body 14, and the latch assembly 212. As illustrated, when the latch assembly 212 is in the unlocked position, no portion of the locking assembly 236 is positioned in front of the second drawer 16B, i.e. no portion of the locking assembly 236 engages and/or is positioned adjacent to the drawer face 26, and the second drawer 16B can be quickly and easily opened and closed without otherwise moving the latch assembly 212. Stated another way, when the latch assembly 212 is in the unlocked position, the locking assembly 236 does not inhibit the second drawer 16B from being opened or closed as desired. It should be noted that although FIG. 4C illustrates the latch assembly 212 selectively engaging and/or being operative relative to a drawer, i.e. to the second drawer 16B, the latch assembly 212 can equally selectively engage and/or be operative relative to a door 30C (illustrated in FIG. 1C) of the cabinet 10C (illustrated in FIG. 1C).

Additionally, as illustrated, the attachment assembly 234 is in the same position relative to the cabinet body 14 and/or the cabinet face 24, regardless of whether the latch assembly 212 is in the unlocked position (as shown in FIG. 4C) or the locked position (as shown in FIG. 2C). More specifically, as shown, when in the unlocked position, the first arm 344 of the attacher body 340 still provides pressure and/or contact on the back 24B of the cabinet face 24, and the second arm 346 of the attacher body 340 still provides pressure and/or contact on the front 24F of the cabinet face 24. Further, the attacher cover 342 still extends underneath the portion of the cabinet face 24 that is positioned substantially between and/or adjacent to the first drawer 16A and the second drawer 16B, and provides pressure and/or contact on a small portion of both the front 24F and the back 24B of the cabinet face 24.

Figure 4D:
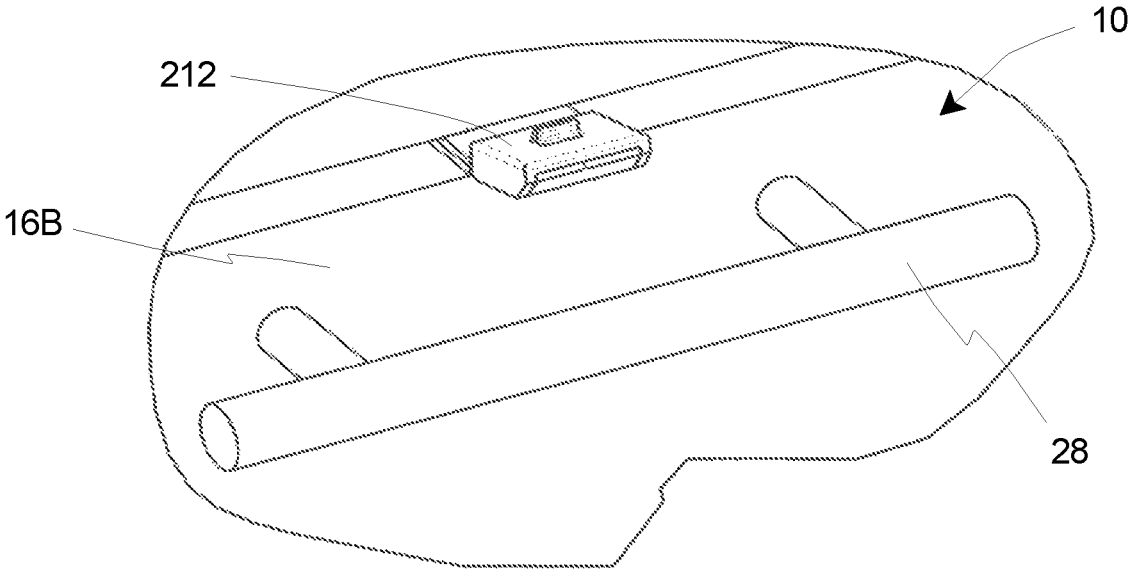
FIG. 4D is an enlarged view illustration of a portion of the cabinet and the latch assembly illustrated in FIG. 4A.

FIG. 4D is an enlarged view illustration of a portion of the cabinet 10 and the latch assembly 212 illustrated in FIG. 4A. More specifically, FIG. 4D illustrates the latch assembly 212 mounted on the second drawer 16B of the cabinet 10, and near the handle 28 of the second drawer 16B.

Figure 5A:
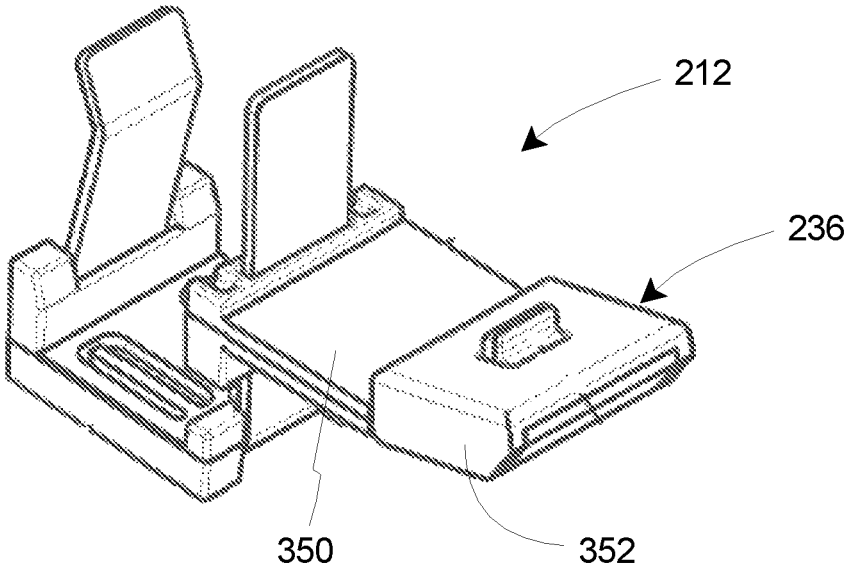
FIG. 5A is a perspective view illustration of the latch assembly illustrated in FIG. 2A, the latch assembly being shown in the unlocked position.

FIG. 5A is a perspective view illustration of the latch assembly 212 illustrated in FIG. 2A, the latch assembly 212 again being shown in the unlocked position. More particularly, FIG. 5A illustrates certain aspects of the locking assembly 236 when the latch assembly 212 is in the unlocked position. For example, as shown, the pivoting member 352 of the locking assembly 236 is now in the second position relative to the transverse member 350. In particular, the pivoting member 352 has been pivoted about the pivot pin 354 (illustrated in FIG. 5D) relative to the transverse member 350 to the second position.

As noted above, and as described in greater detail herein below, when the pivoting member 352 is in the second position, a portion of the pivoting member 352 engages a portion of the transverse member 350, and the pivoting member 352 is inhibited from pivoting relative to the transverse member 350, i.e. from the second position to the first position. However, when the pivoting member 352 is in the second position, and thus the latch assembly 212 is in the unlocked position, the pivoting member 352 allows for large scale movement of the drawer 16B (illustrated in FIG. 4A) or door 30C (illustrated in FIG. 1C) relative to the cabinet body 14 (illustrated in FIG. 4C).

Figure 5B:
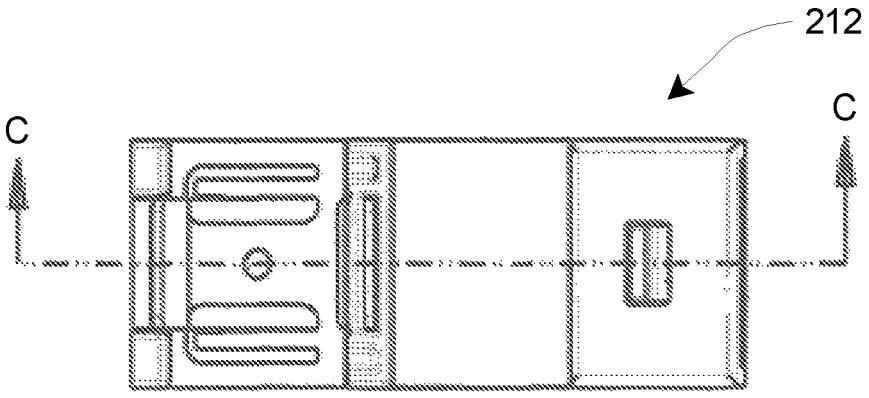
FIG. 5B is a top view illustration of the latch assembly illustrated in FIG. 5A.

FIG. 5B is a top view illustration of the latch assembly 212 illustrated in FIG. 5A.

Figure 5C:
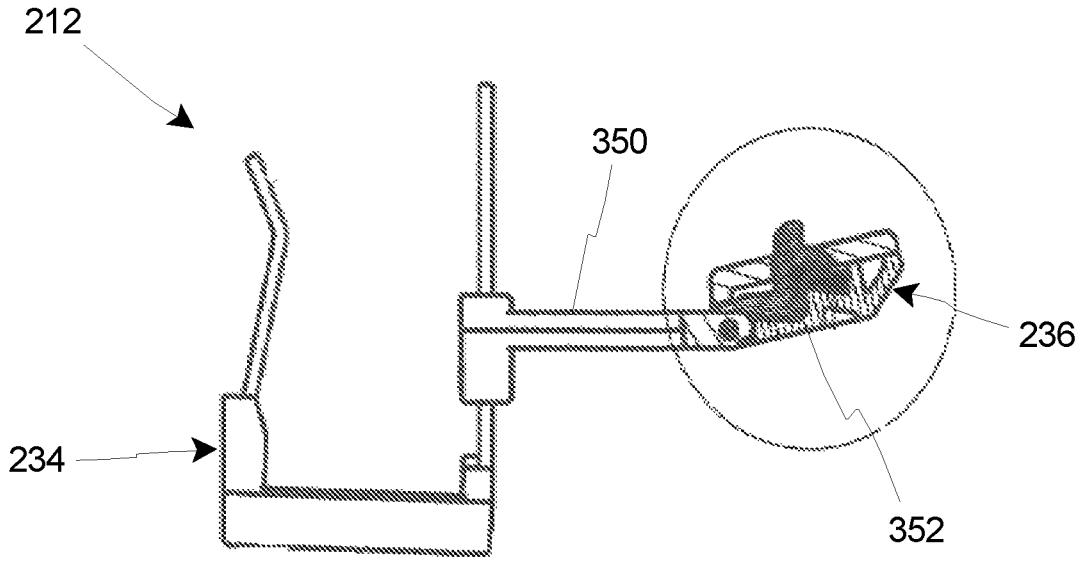
FIG. 5C is a sectional view illustration of the latch assembly taken on line C-C in FIG. 5B.

FIG. 5C is a sectional view illustration of the latch assembly 212 taken on line C-C in FIG. 5B. More particularly, FIG. 5C illustrates the relative orientation and positioning of the attachment assembly 234 and the locking assembly 236 when the latch assembly 212 is in the unlocked position. Moreover, FIG. 5C illustrates the pivoting member 352 in the second position, with the pivoting member 352 positioned substantially parallel to the transverse member 350.

Figure 5D:
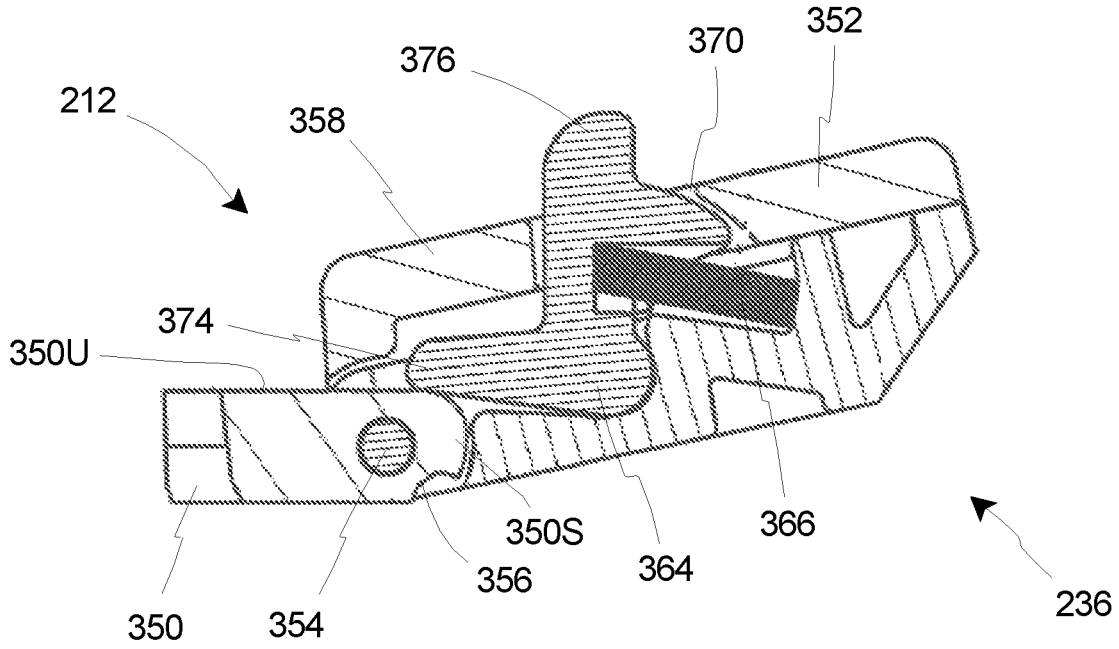
FIG. 5D is an enlarged view illustration of a portion of the sectional view illustration of the latch assembly in FIG. 5C.

FIG. 5D is an enlarged view illustration of a portion of the sectional view illustration of the latch assembly 212 in FIG. 5C. In particular, FIG. 5D is a cross-sectional view of a portion of the locking assembly 236, with the pivoting member 352 in the second position, i.e. the latch assembly 212 is in the unlocked position. As provided above, when the pivoting member 352 is in the second position, a portion of the pivoting member 352 engages a portion of the transverse member 350, and the pivoting member 352 is inhibited from pivoting relative to the transverse member 350. More specifically, as shown in FIG. 5D, when in the second position, the end tab 374 is no longer positioned within the recessed area 356 near the second end 350S of the transverse member 350. Rather, in the second position, the end tab 374 engages an upper surface 350U of the transverse member 350, i.e. when the latch assembly 212 is coupled to the top of a drawer 16 (illustrated in FIG. 1A) or door 30C (illustrated in FIG. 1C) at or near the second end 350S of the transverse member 350.

For purposes of moving the pivoting member 352 from the first position to the second position, the user can manually move the front tab 376 in a translational and/or rotational manner relative to the face plate 358, i.e. within plate aperture 370 and against the bias force provided by the one or more resilient members 366, to move the activator mechanism 364 from the engaged position to the disengaged position. As noted above, when in the engaged position, the end tab 374 is positioned substantially within the recessed area 356. Conversely, when in the disengaged position, the end tab 374 is no longer positioned within the recessed area 356. Thus, when in the disengaged position, the user can freely pivot the pivoting member 352 relative to the transverse member 350 about the pivot pin 354 to the second position, so that the latch assembly 212 is in the unlocked position. When the pivoting member 352 is in the second position and the latch assembly 212 is in the unlocked position, the face plate 358 of the pivoting member 352 is positioned substantially perpendicular to the drawer face 26 (illustrated in FIG. 4C), so that the drawer 16 or door 30C can be freely opened by the user. The user can release the front tab 376 of the activator mechanism 364 once the pivoting member 352 has been moved to the second position, and, as noted, the end tab 374 can engage the upper surface 350U of the transverse member 350.

For purposes of moving the pivoting member 352 from the second position back to the first position, the user can again manually move the front tab 376 in a translational and/or rotational manner relative to the face plate 358, i.e. within plate aperture 370 and against the bias force provided by the one or more resilient members 366. With the front tab 376 so moved, the user can then pivot the pivoting member 352 relative to the transverse member 350 about the pivot pin 354, so that the pivoting member 352 is being moved back toward the first position. Alternatively, in some embodiments, the user can simply overcome the force between the end tab 374 and the upper surface 350U of the transverse member 350 by simply rotating the pivoting member 352 from the second position back to the first position, e.g., without the specific need to manually move the front tab 376 in a translational and/or rotational manner relative to the face plate 358.

Figure 6A:
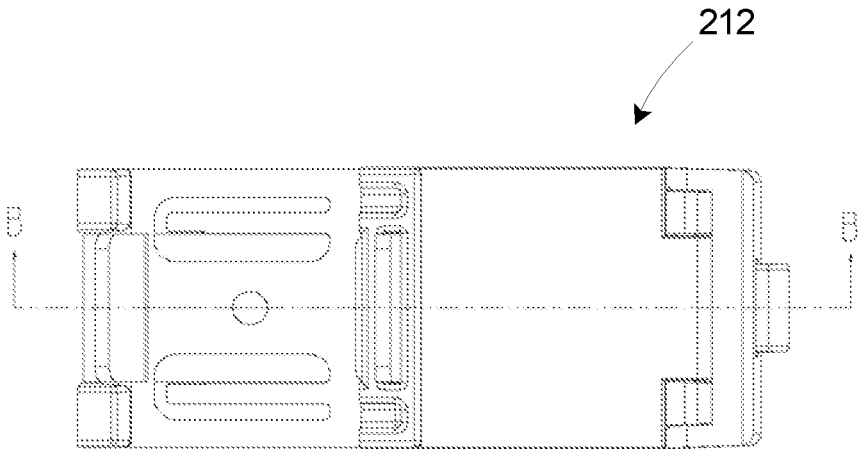
FIG. 6A is a top view illustration of the latch assembly illustrated in FIG. 2A.

FIG. 6A is a top view illustration of the latch assembly 212 illustrated in FIG. 2A.

Figure 6B:
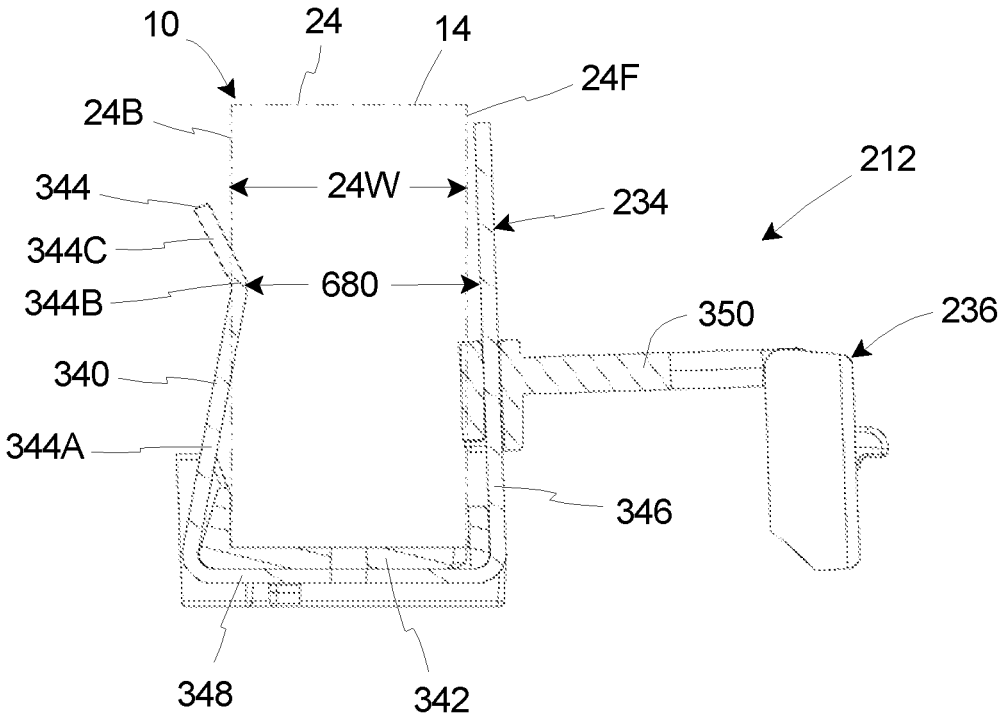
FIG. 6B is a sectional view illustration of the latch assembly taken on line B-B in FIG. 6A.

FIG. 6B is a sectional view illustration of the latch assembly 212 taken on line B-B in FIG. 6A. In particular, FIG. 6B is a sectional view of the locking assembly 236 and a sectional view of the attachment assembly 234, with a portion of the cabinet 10, i.e. a portion of the cabinet body 14, being shown in phantom to better illustrate the required flexing of the spring clamp during use on the cabinet 10.

As noted above, when the attachment assembly 234 is attached to the cabinet body 14 and/or the cabinet face 24 and the locking assembly 236, i.e. the transverse member 350 of the locking assembly 236, is adjustably coupled to the attachment assembly 234, the first arm 344 of the attacher body 340 is positioned to provide pressure and/or contact to the back 24B of the cabinet face 24, and the second arm 346 of the attacher body 340 is positioned to provide pressure and/or contact to the front 24F of the cabinet face 24. It is appreciated that FIG. 6B does not show any direct contact between the second arm 346 and the front 24F of the cabinet face 24; however, it is further appreciated that when the locking assembly 236, i.e. the transverse member 350, is adjustably coupled to the attachment assembly 234, the second arm 346 will be deflected so as to provide pressure to the front 24F of the cabinet face 24. Additionally, in this embodiment, a portion of the attacher cover 342 is positioned substantially directly adjacent to a horizontal surface of the cabinet body 14.

As illustrated, in some embodiments, the first arm 344 as it extends away from the attacher base 348 includes a first section 344A that angles slightly inwardly toward the second arm 346 until it reaches an inflection point 344B, and then after the inflection point 344B the first arm 344 includes a second section 344C that angles slightly outwardly away from the second arm 346. In certain such embodiments, the first arm 344 is configured so that only the inflection point 344B of the first arm 344 contacts the back 24B of the cabinet face 24 when the attachment assembly 234 is attached to the cabinet body 14 and/or the cabinet face 24. Additionally, in such embodiments, the second arm 346 can angle slightly inwardly toward the first arm 344 as it extends away from the attacher base 348. With such design, depending on the specific positioning of the locking assembly 236 (illustrated in FIG. 2A) relative to the attachment assembly 234, i.e. relative to the second arm 346 of the attacher body 340, in various embodiments, no part of the second arm 346 may directly contact the front 24F of the cabinet face 24. Alternatively, the first arm 344 and/or the second arm 346 can have a different design.

During use of the attachment assembly 234, the attacher body 340 is movable between a relaxed position, when the attacher body 340 is in its natural state and no pressure is applied to either of the arms 344, 346, and a clamping position, when the attachment assembly 234 and/or the attacher body 340 is attached to the cabinet body 14 and/or the cabinet face 24. As shown in FIG. 6B, the attacher body 340 is in the relaxed position. Notably illustrated is the idea that when the attacher body 340 is in the relaxed position, an arm spacing 680 between the first arm 344 and the second arm 346 at a closest, minimum point (e.g., at the inflection point 344B) should be less than a face width 24W of the cabinet face 24 with which the latch assembly 212 is being used. For example, in one specific non-exclusive embodiment, the arm spacing 680 between the first arm 344 and the second arm 346 at such closest point can be between approximately 0.70 inches and 0.72 inches, and the face width 24W of the cabinet face 24 can be between approximately 0.74 inches and 0.76 inches. Thus, in such situation, when the attacher body 340 is then positioned around the cabinet face 24, i.e. when the attacher body 340 is in the clamping position, the arm spacing 680 between the first arm 344 and the second arm 346 will necessarily be greater than when the attacher body 340 is in the relaxed position. Thus, with the arms 344, 346 being flexibly coupled to one another via the attacher base 348, and with the arm spacing 680 being greater when the attacher body 340 is in the clamping position, the arms 344, 346 will then be able to provide the necessary pressure and/or contact with the back 24B and the front 24F of the cabinet face 24, respectively, such that the attachment assembly 234 can be effectively held in the desired position relative to the cabinet face 24. Accordingly, it is appreciated that the latch assembly 212 can be designed to be of different sizes to be able to be effectively used with cabinets 10 and/or cabinet faces 24 of different sizes (widths).

Additionally, it is further appreciated that the design of the second section 344C of the first arm 344, which angles slightly away from the second arm 346, makes installation of the attachment assembly 234 easier, as the ends of the arms 344, 346 away from the attacher base 348 will typically be spaced apart from one another a distance that is greater than the face width 24W of the cabinet face 24 with which the latch assembly 212 is being used.

As noted at least in part herein above, the latch assembly 212 and the various components thereof can be formed from materials that are soft enough so as to inhibit any marring (denting, scratching, etc.) of the surfaces of the cabinet 10 when the latch assembly 212 is coupled to and being used to selectively latch drawers 16 (illustrated in FIG. 1A) or doors 30C (illustrated in FIG. 1C) of the cabinet 10. More specifically, it is desired that any components of the latch assembly 212 that are configured to be in contact with any surfaces of the cabinet 10, e.g., the attacher body 340 and the attacher cover 342 of the attachment assembly 234, and the transverse member 350 and the plates 358, 360 of the rotational member 352 of the locking assembly 236, be formed from such materials. However, it is further appreciated that in some embodiments, the attacher body 340, which only minimally contacts the cabinet face 24, may be formed from a stronger material, e.g., one or more suitable metallic materials, so as to provide the desired holding strength relative to the cabinet face 24.

Figure 7A:
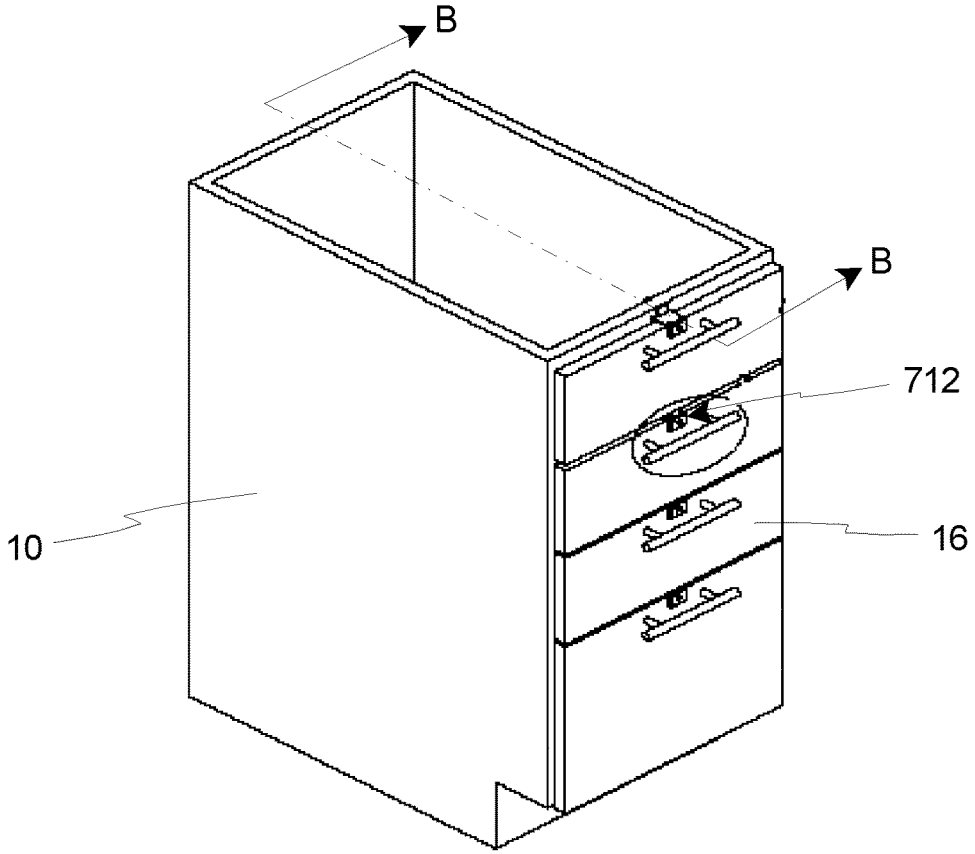
FIG. 7A is a perspective view illustration of a portion of the cabinet and another embodiment of the latch assembly, the latch assembly being shown in the locked position.

FIG. 7A is a perspective view illustration of a portion of the cabinet 10 and another embodiment of the latch assembly 712. More particularly, as shown in FIG. 7A, a separate latch assembly 712 is shown as being selectively attached to and/or operative relative to each of the drawers 16 of the cabinet 10. Further, in FIG. 7A, each latch assembly 712 is being shown in the locked position.

Figure 7B:
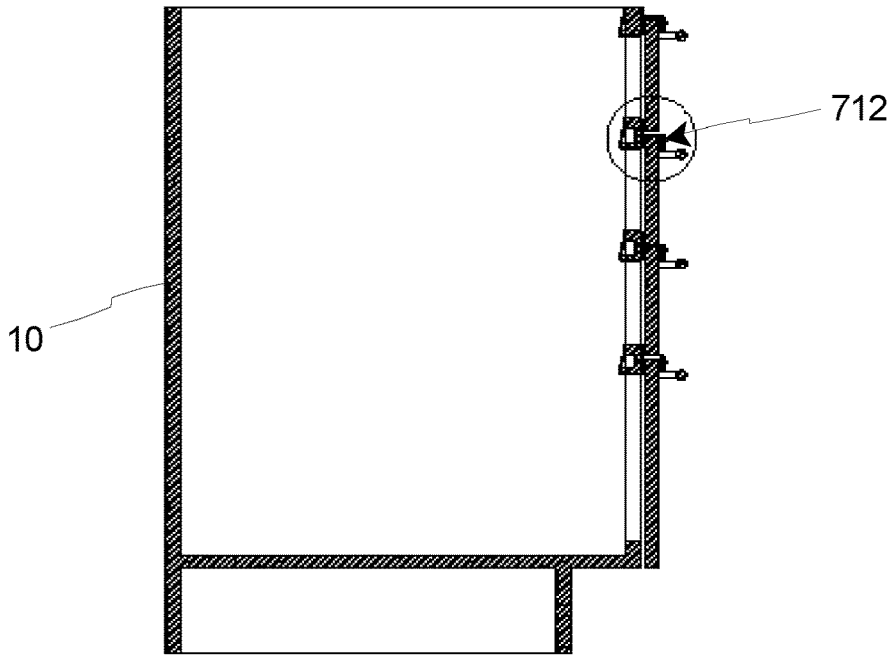
FIG. 7B is a sectional view illustration of the portion of the cabinet and the latch assembly taken on line B-B in FIG. 7A.

FIG. 7B is a sectional view illustration of the portion of the cabinet 10 and the latch assembly 712 taken on line B-B in FIG. 7A. Additionally, in FIG. 7B, each latch assembly 712 is again being shown in the locked position.

Figure 7C:
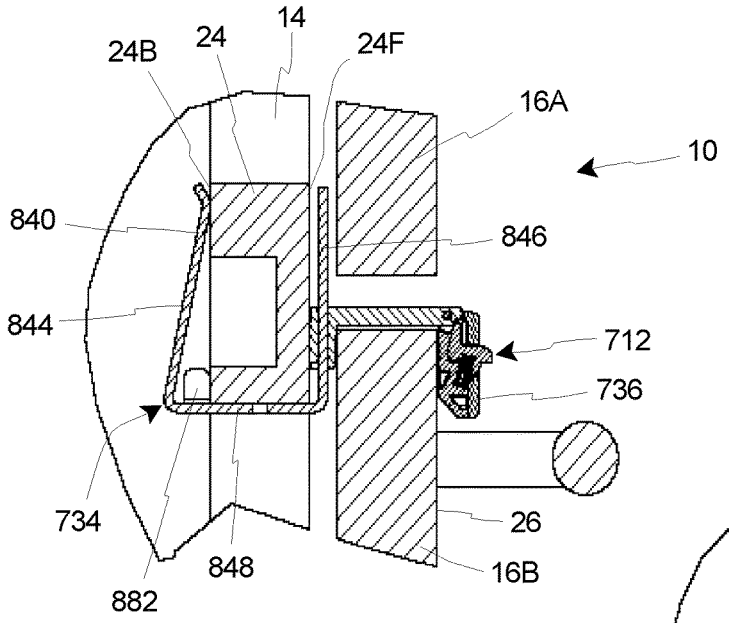
FIG. 7C is an enlarged view illustration of a portion of the sectional view illustration of the portion of the cabinet and the latch assembly in FIG. 7B.

FIG. 7C is an enlarged view illustration of a portion of the sectional view illustration of the portion of the cabinet 10 and the latch assembly 712 in FIG. 7B. In particular, FIG. 7C illustrates a portion of the first drawer 16A, a portion of the second drawer 16B, a portion of the cabinet body 14, and the latch assembly 712. As shown, the latch assembly 712 selectively engages and/or is operative relative to the second drawer 16B. Further, the latch assembly 712 is in the locked position so that the second drawer 16B cannot readily be opened without otherwise moving the latch assembly 712 to the unlocked position. It should be noted that although FIG. 7C illustrates the latch assembly 712 selectively engaging and/or being operative relative to a drawer, i.e. to the second drawer 16B, the latch assembly 712 can equally selectively engage and/or be operative relative to a door 30C (illustrated in FIG. 1C) of the cabinet 10C (illustrated in FIG. 1C).

As illustrated in FIG. 7C, the cabinet body 14 includes the cabinet face 24, with at least a portion of the cabinet face 24 positioned substantially between and/or adjacent to the drawers 16A, 16B so as to allow a certain amount of spacing between adjacent drawers 16A, 16B. The cabinet face 24 faces generally outward away from the rest of the cabinet body 14 in the same direction as the drawers 16A, 16B.

The design of the latch assembly 712 can be varied to suit the specific requirements of the cabinet 10. Additionally, as shown, the latch assembly 712 is somewhat similar to the latch assembly 212 illustrated and described in detail herein above. In the embodiment illustrated in FIG. 7C, the latch assembly 712 includes an attachment assembly 734, and a locking assembly 736 that is adjustably coupled to the attachment assembly 734. As illustrated, the locking assembly 736 is substantially similar to the locking assembly 236 illustrated and described herein above. Accordingly, not all details of the locking assembly 736 will be described in detail. However, in this embodiment, the attachment assembly 734 is somewhat different than the previous embodiment.

As with the previous embodiment, the present invention incorporates the attachment assembly 734 in the form of a spring clamp for mounting to a given cabinet 10. This utilization removes the need for mounting screws or adhesives plus allows for more implementation possibilities based on space constraints within the cabinet 10, e.g., a laundry cabinet with a deep sink. The spring clamp of the present invention provides enough clamping force between the attachment assembly 734 and the cabinet face 24 to keep it at the proper location relative to the cabinet drawer 16B or door 30C. Additionally, the height adjustment of the locking assembly 736 in the present invention is accomplished simply by moving it up or down on the attachment assembly 734, i.e. the spring clamp, thus giving a large adjustable range based on the requirements of a particular cabinet. This aspect of the present invention further reduces the installation, alignment and removal time as compared to existing safety latch assemblies currently available.

As shown, the attachment assembly 734 is selectively attached to the cabinet 10, e.g., to the cabinet body 14, to selectively couple the locking assembly 736 to the cabinet 10, e.g., to the cabinet body 14. Additionally, the attachment assembly 734, as described herein, selectively couples the locking assembly 736 to the cabinet body 14 without damaging the visible part of the cabinet body 14.

The design of the attachment assembly 734 can be varied to suit the specific requirements of the latch assembly 712 and/or the cabinet 10. In the embodiment illustrated in FIG. 7C, the attachment assembly 734 is again provided in the form of a spring clamp that selectively provides pressure and/or contact on both the front 24F and the back 24B of the cabinet face 24 to selectively couple the locking assembly 736 to the cabinet face 24. Alternatively, the attachment assembly 734 can have a different design.

In this embodiment, the locking assembly 736 is adjustably secured to the attachment assembly 734. The locking assembly 736 provides the operative portion of the latch assembly 712 so that the latch assembly 712 can be quickly and easily moved between the locked position, as illustrated in FIG. 7C, and the unlocked position, as illustrated, for example, in FIG. 9C. As shown, when in the locked position, a portion of the locking assembly 736 engages and/or is positioned in front of the second drawer 16B, i.e. engages and/or is positioned adjacent to the drawer face 26, so that the second drawer 16B is inhibited from being opened. Further, with this design, the locking assembly 736 is easily visible to the user of the cabinet 10. Moreover, the positioning of the portion of the locking assembly 736 so that it engages and/or is positioned adjacent to the drawer face 26 or door face when in the locked position, limits the movement of the drawer 16 or door 30C so as to inhibit the pinching of fingers between the drawer 16 or door 30C and the cabinet face 24.

Additionally, as with the previous embodiment, the attachment assembly 734 and/or the locking assembly 736 can include features that enable the locking assembly 736 to be adjustably secured to the attachment assembly 734. This capability further adjusts the position of the locking assembly 736 relative to the attachment assembly 734 and, thus, adjusts the position of the locking assembly 736 relative to the drawers 16A, 16B and the cabinet body 14. Additionally, this capability adjusts the position of the locking assembly 736 to enable the latch assembly 212 to be used on drawers 16A, 16B or doors 30C of different heights relative to the cabinet face 24. Further, the adjustability of the locking assembly 736 relative to the attachment assembly 734 enables the latch assembly 212 to be used with a wider range of cabinet styles available on the market, and allows the possibility of mounting the latch assembly 712 on either the top, bottom or side of the particular cabinet drawer 16A, 16B, or the top, bottom or side of a cabinet door 30C. The various components of the latch assembly 712, i.e. the attachment assembly 734 and the locking assembly 736, will be described in greater detail herein below.

Figure 7D:
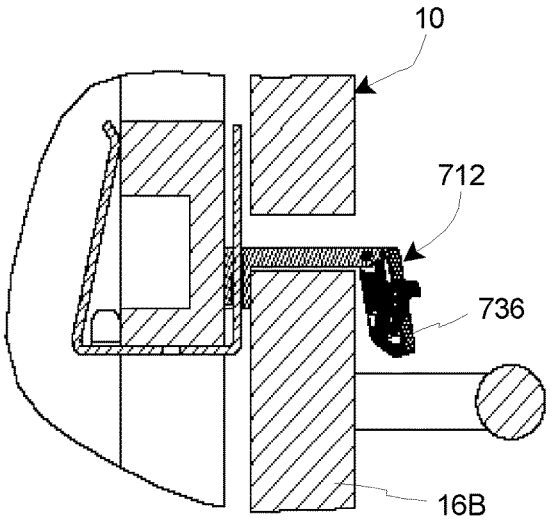
FIG. 7D is an enlarged view illustration of a portion of the sectional view illustration of the portion of the cabinet and the latch assembly in FIG. 7B, the latch assembly being shown in the pre-travel position.

FIG. 7D is another enlarged view illustration of a portion of the sectional view illustration of the portion of the cabinet 10 and the latch assembly 712 in FIG. 7B. However, in FIG. 7D, the latch assembly 712 is now being shown in the pre-travel position. In particular, as shown, the extent of possible pre-travel of the locking assembly 736, i.e. relative to the drawer 16B or door 30C (illustrated in FIG. 1C) to which the latch assembly 712 is secured, is fairly limited, so as to better inhibit any potential pinching of fingers.

Figure 7E:
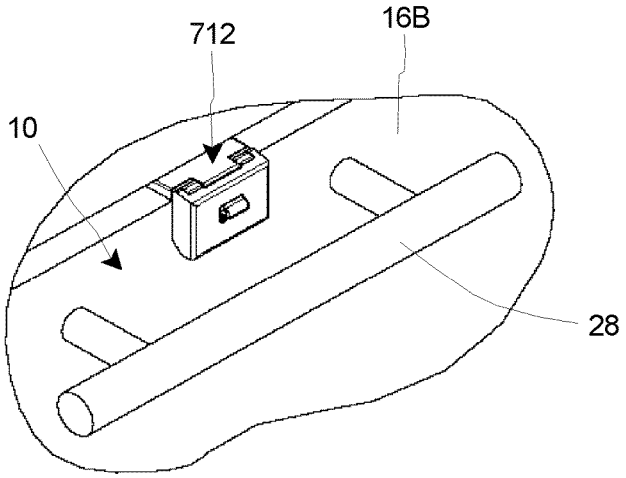
FIG. 7E is an enlarged view illustration of a portion of the cabinet and the latch assembly illustrated in FIG. 7A.

FIG. 7E is an enlarged view illustration of a portion of the cabinet 10 and the latch assembly 712 illustrated in FIG. 7A. More specifically, FIG. 7E illustrates the latch assembly 712 mounted on the second drawer 16B of the cabinet 10, and near the handle 28 of the second drawer 16B.

Figure 8A:
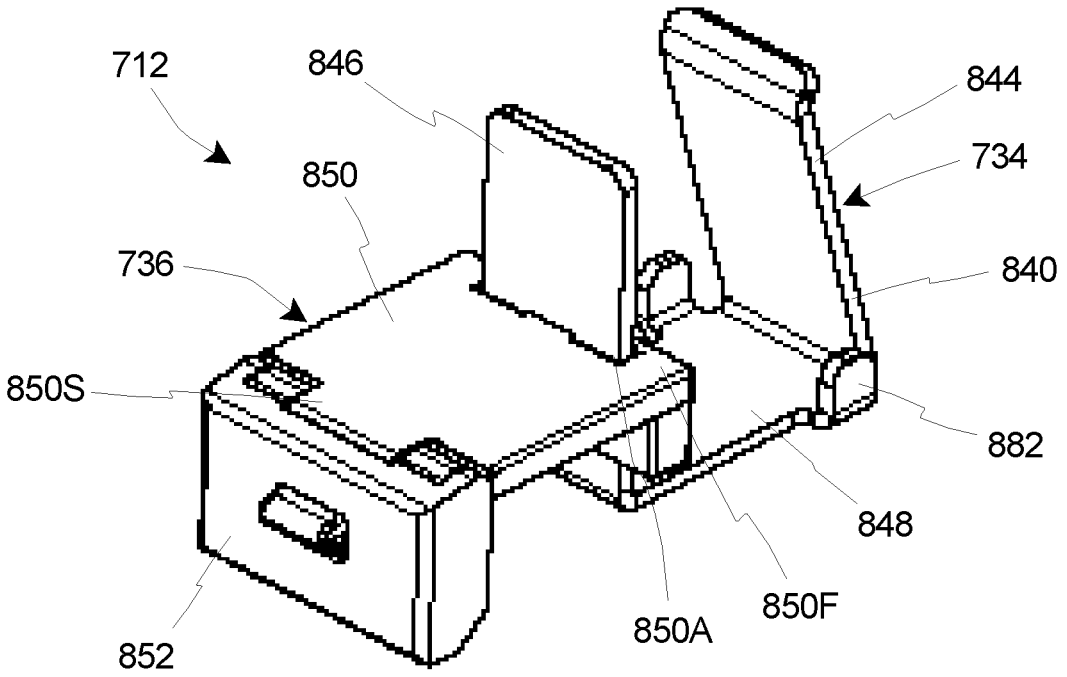
FIG. 8A is a perspective view illustration of the latch assembly illustrated in FIG. 7A, the latch assembly being shown in the locked position.

FIG. 8A is a perspective view illustration of the latch assembly 712 illustrated in FIG. 7A, the latch assembly 712 again being shown in the locked position. In particular, FIG. 8A illustrates certain features of and the interrelationship between the attachment assembly 734 and the locking assembly 736.

As provided above, the attachment assembly 734 selectively couples the locking assembly 736 to the cabinet body 14 (illustrated, for example, in FIG. 1A). Additionally, as noted above, the design of the attachment assembly 734 in this embodiment is somewhat different than in the previous embodiment. In this embodiment, the attachment assembly 734 is again provided generally in the form of a spring clamp and includes an attacher body 840. However, in this embodiment, the attachment assembly 734 further includes an attacher aligner 882 that is coupled to the attacher body 840.

As illustrated in the embodiment shown in FIG. 8A, the attacher body 840 is again substantially U-shaped and includes a first (inner) arm 844, a second (outer) arm 846, and an attacher base 848 that extends between the first arm 844 and the second arm 846 to flexibly couple the first arm 844 and the second arm 846 to one another. Additionally, as shown, the attacher aligner 882 can be somewhat arch-shaped and can be positioned adjacent to the attacher base 848 and near where the attacher base 848 joins the first arm 844. Alternatively, the attacher body 840 and/or the attacher aligner 882 can have a different design or shape than what is illustrated and described herein.

Referring back to FIG. 7C, in one embodiment, the attacher body 840, i.e. the spring clamp, is adapted to be positioned about the portion of the cabinet body 14, i.e. the portion of the cabinet face 24, that is positioned substantially between and/or adjacent to the first drawer 16A and the second drawer 16B. Additionally, as shown in FIG. 7C, with the latch assembly 712 selectively engaging and/or operative relative to the top of the second drawer 16B to selectively maintain the second drawer 16B in the closed position, the attacher body 840 extends underneath the portion of the cabinet face 24 that is positioned substantially between and/or adjacent to the first drawer 16A and the second drawer 16B. Additionally, as shown, when the attachment assembly 734 and/or the attacher body 840 is mounted on and/or secured to the cabinet body 14, i.e. in a clamping position, the first arm 844 of the attacher body 840 provides pressure and/or contact on the back 24B of the cabinet face 24, and the second arm 846 of the attacher body 840 provides pressure and/or contact on the front 24F of the cabinet face 24. It is appreciated that the first arm 844 and the second arm 846 of the attacher body 840 can provide sufficient pressure and/or contact with the back 24B and the front 24F of the cabinet face 24, respectively, to maintain the desired positioning of the latch assembly 712 relative to the drawers 16A, 16B of the cabinet 10, due to the flexibility of the arms 844, 846 relative to one another in the spring clamp design.

Further, as shown in FIG. 7C, the attacher aligner 882 is positioned along the attacher base 848 in such a manner that the attacher aligner 882 is positioned substantially adjacent to, if not directly in contact with the back 24B of the cabinet face 24. With such positioning, the attacher aligner 882 can further provide a small amount of pressure and/or contact on the back 24B of the cabinet face 24. Additionally, the attacher aligner 882 is also utilized to properly orient and/or align the attachment assembly 734 and/or the attacher body 840 relative to the cabinet face 24.

As above, it is appreciated that in different embodiments, different size attacher bodies 840, e.g., clamp bodies, may be required depending on the size of the cabinet 10 or drawers 16A, 16B or door 30C (illustrated in FIG. 1C). Additionally, the attacher body 840, i.e. the first arm 844, the second arm 846 and the attacher base 848, and the attacher aligner 882 can be formed from any suitable materials. For example, in some embodiments, the attacher body 840 can be formed from any suitable metallic materials. With such design, the attacher body 840 can have sufficient strength properties so as to not fail when a force is applied through the cabinet drawers 16A, 16B or door 30C. Additionally, in such embodiments, the attacher body 840 will not cause any significant damage to any surfaces of the cabinet 10, i.e. especially not any visible surfaces of the cabinet 10, as there is only limited direct contact between the attacher body 840 and the cabinet face 24. Alternatively, the attacher body 840 can be made of other suitable materials.

Additionally, in various embodiments, it is desired that the attacher aligner 882 be formed from material soft enough to inhibit scratching or dents to the cabinet face 24. For example, in one non-exclusive embodiment, the attacher aligner 882 can be formed from molded plastic. Alternatively, the attacher aligner 882 can be made of other suitable materials.

Referring again to FIG. 8A, the features and operation of the locking assembly 736 will now be briefly described. As noted above, the locking assembly 736 is substantially similar to, if not identical to, the locking assembly 236 illustrated and described in detail above. As above, the locking assembly 736 is adjustably secured to the attachment assembly 734 so as to enable the latch assembly 712 to be quickly and easily moved between the locked position and the unlocked position. Additionally, as shown, the locking assembly 736 again includes a transverse member 850 and a pivoting member 852 that is pivotally coupled to the transverse member 850.

As shown, the transverse member 850 is adjustably secured to and cantilevers substantially perpendicularly away from the attacher body 840, i.e. from the second arm 846 of the attacher body 840. Further, when installed, the transverse member 850 is designed to extend substantially along an edge, i.e. along the top, the bottom or possibly a side, of the drawer 16B (illustrated, for example, in FIG. 7C) or door 30C (illustrated in FIG. 1C) of the cabinet 10. As illustrated, the transverse member 850 has a substantially square, flat plate-like design and includes a first end 850F, and an opposed second end 850S. Additionally, as shown, the first end 850F of the transverse member 850 is adjustably secured to the attacher body 840. More specifically, in this embodiment, the first end 850F of the transverse member 850 includes a slot-shaped aperture 850A that fits over and can be maintained securely in position around the second arm 846 of the attacher body 840. In one embodiment, the relative positioning between the transverse member 850 and the second arm 846 can be effectively maintained due to a frictional force that exists there between. Thus, with such design, the transverse member 850 can be moved, e.g., vertically, along and/or relative to the second arm 846 of the attacher body 840 to adjust a desired position, e.g., height, of the transverse member 850 relative to the attacher body 840. More specifically, FIG. 8A illustrates the transverse member 850, and thus the locking assembly 736, at a first position, e.g., height, along and/or relative to the second arm 846 and/or the attacher body 840. Additionally, or in the alternative, the transverse member 850, and thus the locking assembly 736, can be positioned at any other suitable position, e.g., a second position, a third position, a fourth position, etc., along and/or relative to the second arm 846 and/or the attacher body 840. Examples of multiple positions, e.g., a first position and a second position, are shown herein below in FIGS. 11B and 11C. It is appreciated that the specific position chosen for the transverse member 850 relative to the attacher body 840 can be selected so as to fit drawers 16B or doors 30C of different sizes and/or to accommodate different sizes of the cabinet body 14.

Additionally, in this embodiment, the pivoting member 852 is pivotally secured to the transverse member 850 such that the pivoting member 852 is pivotally coupled to the attachment assembly 734. More particularly, as shown in this embodiment, the pivoting member 852 is pivotally secured to the second end 850S of the transverse member 850. Further, the pivoting member 852 is adapted to pivot about a pivot pin 854 (illustrated in FIG. 8E) relative to the transverse member 850 between a first position (as illustrated in FIG. 8A), with the latch assembly 712 in the locked position, and a second position (as illustrated, for example, in FIG. 10A), with the latch assembly 712 in the unlocked position.

As with the previous embodiment, a portion of the pivoting member 852 selectively engages a portion of the transverse member 850 to selectively inhibit the pivoting member 852 from pivoting relative to the transverse member 850. For example, when the pivoting member 852 is in the first position, a portion of the pivoting member 852 engages a portion of the transverse member 850, and the pivoting member 852 is inhibited from pivoting relative to the transverse member 850, i.e. from the first position to the second position. Moreover, when the pivoting member 852 is in the first position, the pivoting member 852 inhibits the drawer 16B or door 30C from other than slight movement, e.g., very limited pre-travel, relative to the cabinet body 14, i.e. the pivoting member 852 inhibits large scale movement of the drawer 16B or door 30C relative to the cabinet body 14.

Additionally, when the pivoting member 852 is in the second position, a portion of the pivoting member 852 engages a portion of the transverse member 850, and the pivoting member 852 is inhibited from pivoting relative to the transverse member 850, i.e. from the second position to the first position. However, when the pivoting member 852 is in the second position, and thus the latch assembly 712 is in the unlocked position, the pivoting member 852 allows for large scale movement of the drawer 16B or door 30C relative to the cabinet body 14.

Figure 8B:
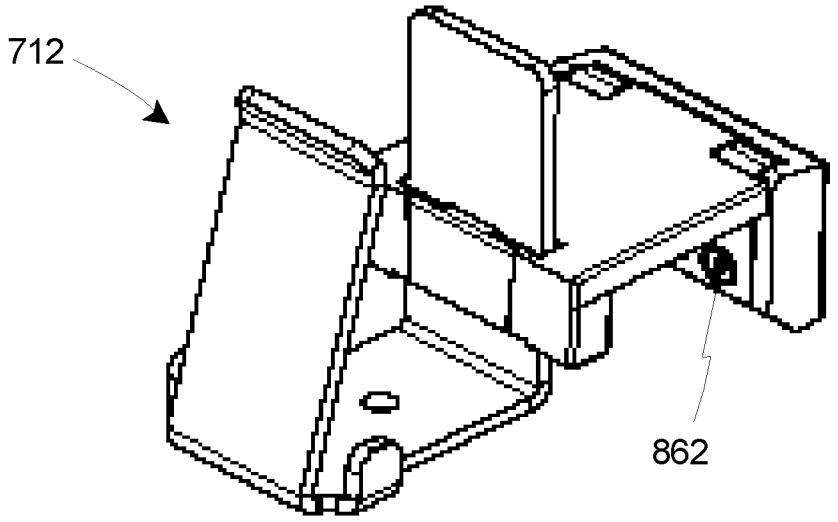
FIG. 8B is another perspective view illustration of the latch assembly illustrated in FIG. 8A.

FIG. 8B is another perspective view illustration of the latch assembly 712 illustrated in FIG. 8A.

Figure 8C:
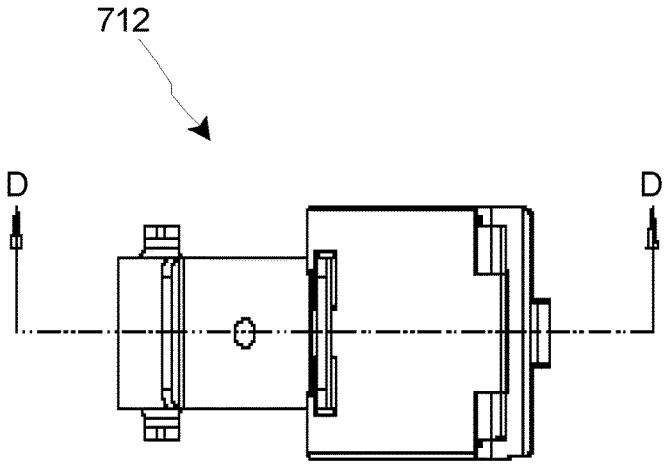
FIG. 8C is a top view illustration of the latch assembly illustrated in FIG. 8A.

FIG. 8C is a top view illustration of the latch assembly 712 illustrated in FIG. 8A.

Figure 8D:
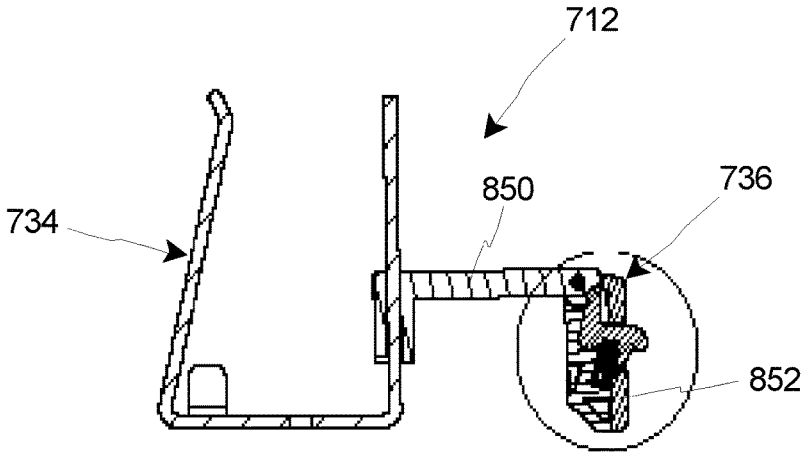
FIG. 8D is a sectional view illustration of the latch assembly taken on line D-D in FIG. 8C.

FIG. 8D is a sectional view illustration of the latch assembly 712 taken on line D-D in FIG. 8C. More particularly, FIG. 8D illustrates the relative orientation and positioning of the attachment assembly 734 and the locking assembly 736 when the latch assembly 712 is in the locked position. Moreover, FIG. 8D illustrates the pivoting member 852 in the first position, with the pivoting member 852 positioned substantially perpendicular to the transverse member 850.

Figure 8E:
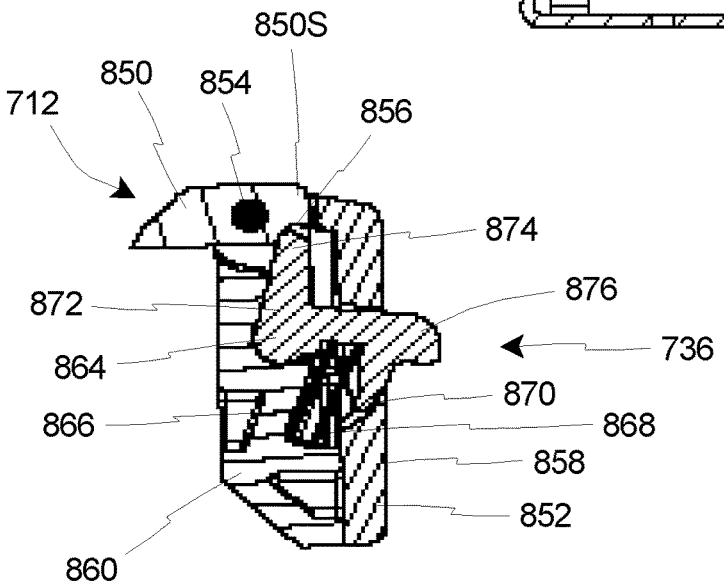
FIG. 8E is an enlarged view illustration of a portion of the sectional view illustration of the latch assembly in FIG. 8D.

FIG. 8E is an enlarged view illustration of a portion of the sectional view illustration of the latch assembly 712 in FIG. 8D. In particular, FIG. 8E is a cross-sectional view of a portion of the locking assembly 736, with the pivoting member 852 in the first position, i.e. the latch assembly 712 is in the locked position. As provided above, when the pivoting member 852 is in the first position, a portion of the pivoting member 852 engages a portion of the transverse member 850, and the pivoting member 852 is inhibited from pivoting relative to the transverse member 850. For example, in this embodiment, the transverse member 850 of the locking assembly 736 includes a recessed area 856 positioned near the second end 850S. As shown, the recessed area 856 can be a small notch that is formed into the transverse member 850 near the second end 850S. The recessed area 856 is adapted to selectively receive and retain a portion of the pivoting member 852 of the locking assembly 736.

Additionally, as illustrated in this embodiment, the pivoting member 852 includes a face plate 858, a back plate 860, one or more plate attachers 862 (illustrated in FIG. 8B), an activator mechanism 864, and one or more resilient members 866, which are substantially similar in design and function to what was illustrated and described in relation to the previous embodiment. Accordingly, the interrelationships between and functionality of the various components of the pivoting member 852 are not restated here.

As shown, the face plate 858 and the back plate 860 cooperate to define a member cavity 868, with the activator mechanism 864 and the one or more resilient members 866 being positioned substantially within the member cavity 868. Further, the face plate 858 and the back plate 860 cooperate to guide the movement of the activator mechanism 864 within the member cavity 868. Additionally, the face plate 858 further includes a plate aperture 870, with a portion of the activator mechanism 864, i.e. a front tab 876 of the activator mechanism 864, being adapted to extend through the plate aperture 870.

As illustrated in this embodiment, the activator mechanism 864 again includes a mechanism body 872 having an end tab 874 and the front tab 876. The end tab 874 extends away from an end of the mechanism body 872, and can be selectively positioned within the recessed area 856 that is formed at or near the second end 850S of the transverse member 850. More particularly, as shown in FIG. 8E, when the pivoting member 852 is in the first position, i.e. when the latch assembly 712 is in the locked position, the end tab 874 is positioned substantially within the recessed area 856.

Additionally, as in the previous embodiment, the front tab 876 cantilevers away from the rest of the mechanism body 872, with at least a portion of the front tab 876 being adapted to extend through the plate aperture 870. The plate aperture 870 is sized and shaped so as to allow for limited translational and/or rotational movement of the front tab 876, and thus the activator mechanism 864, relative to the face plate 858. In particular, the activator mechanism 864, via the manual movement of the front tab 876 in a translational and/or rotational manner relative to the face plate 858, is selectively movable between an engaged position and a disengaged position. When in the engaged position, the end tab 874 can be positioned substantially within the recessed area 856, as shown in FIG. 8E, the latch assembly 712 is in the locked position, and the pivoting member 852 is inhibited from pivoting relative to the transverse member 850. Conversely, when in the disengaged position, the end tab 874 has been removed from the recessed area 856 and the pivoting member 852 can be pivoted, e.g., by approximately ninety degrees, relative to the transverse member 850, so that the latch assembly 712 is in the unlocked position.

As provided above, the one or more resilient members 866 are positioned substantially within the member cavity 868. Additionally, in some embodiments, the one or more resilient members 866 can be biased so as to maintain the end tab 874 positioned within the recessed area 856 of the transverse member 850 absent intentional movement of the front tab 876 of the activator mechanism 864 relative to the face plate 858 within the plate aperture 870. With this design, the latch assembly 712 will be inhibited from inadvertently or unintentionally moving from the locked position to the unlocked position.

When the pivoting member 852 is in the first position and the latch assembly 712 is in the locked position, the face plate 858 of the pivoting member 852 is positioned in front of a portion of one of the drawers 16 (illustrated in FIG. 1A) or the door 30C (illustrated in FIG. 1C), e.g., is substantially parallel to the drawer face 26 (illustrated in FIG. 2C), so that the drawer 16 or door 30C is inhibited from being opened.

In one embodiment, at least a portion of transverse member 850 and/or the pivoting member 852 can be made of a softer material, e.g., molded plastic, to protect the finish of the drawer 16 or door 30C of the cabinet 10 (illustrated in FIG. 1A) from scratches or dents.

Figure 9A:
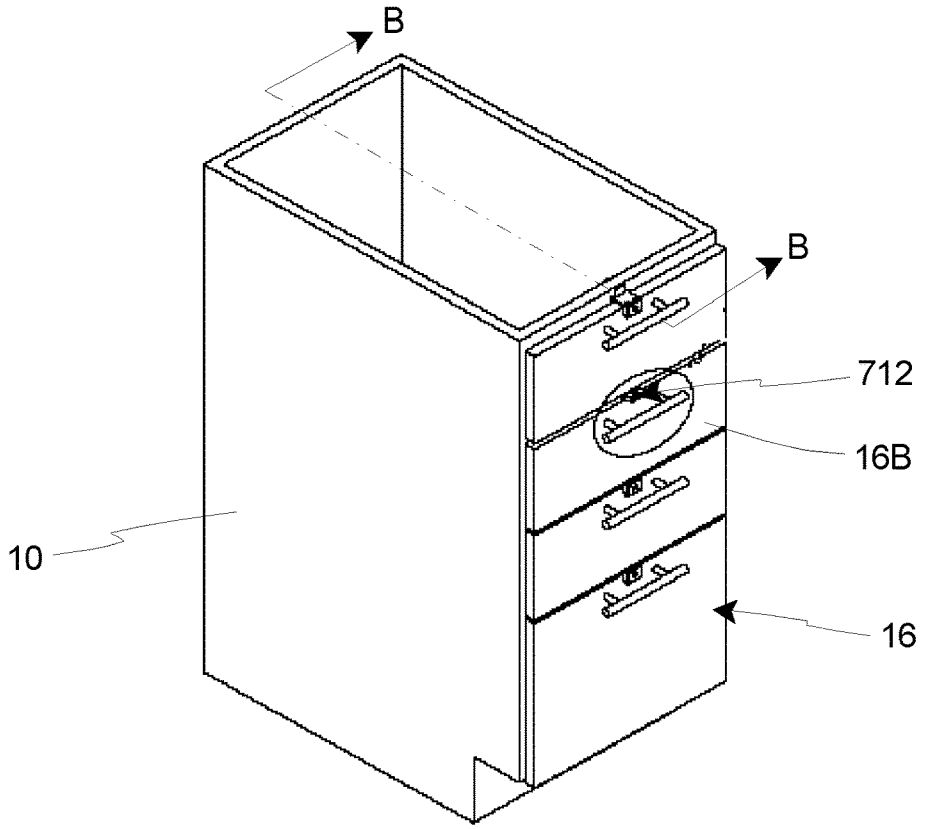
FIG. 9A is a perspective view illustration of a portion of the cabinet and the latch assembly illustrated in FIG. 7A, the latch assembly being shown in the unlocked position.

FIG. 9A is a perspective view illustration of a portion of the cabinet 10 and the latch assembly 712 illustrated in FIG. 7A. More particularly, as shown in FIG. 9A, a separate latch assembly 712 is shown as being selectively attached to and/or operative relative to each of the drawers 16 of the cabinet 10. Further, in FIG. 9A, the latch assembly 712 attached to and/or operative relative to the second drawer 16B is being shown in the unlocked position.

Figure 9B:
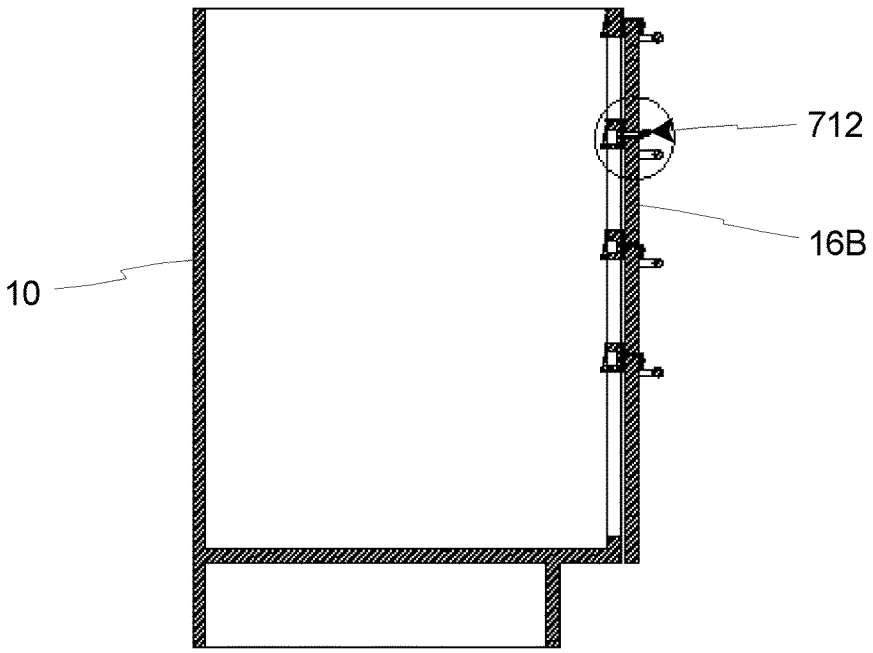
FIG. 9B is a sectional view illustration of the portion of the cabinet and the latch assembly taken on line B-B in FIG. 9A.

FIG. 9B is a sectional view illustration of the portion of the cabinet 10 and the latch assembly 712 taken on line B-B in FIG. 9A. Additionally, in FIG. 9B, the latch assembly 712 attached to and/or operative relative to the second drawer 16B is again being shown in the unlocked position.

Figure 9C:
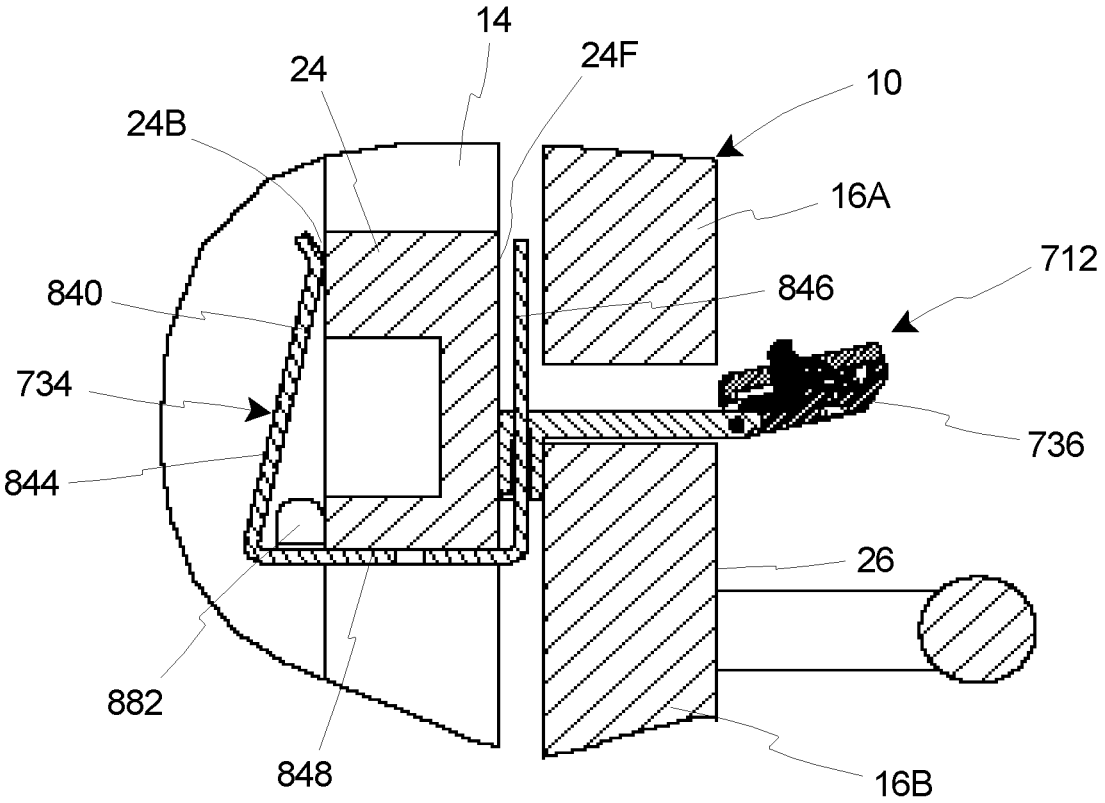
FIG. 9C is an enlarged view illustration of a portion of the sectional view illustration of the portion of the cabinet and the latch assembly in FIG. 9B.

FIG. 9C is an enlarged view illustration of a portion of the sectional view illustration of the portion of the cabinet 10 and the latch assembly 712 in FIG. 9B. In particular, FIG. 9C illustrates a portion of the first drawer 16A, a portion of the second drawer 16B, a portion of the cabinet body 14, and the latch assembly 712. As illustrated, when the latch assembly 712 is in the unlocked position, no portion of the locking assembly 736 is positioned in front of the second drawer 16B, i.e. no portion of the locking assembly 736 engages and/or is positioned adjacent to the drawer face 26, and the second drawer 16B can be quickly and easily opened and closed without otherwise moving the latch assembly 712. Stated another way, when the latch assembly 712 is in the unlocked position, the locking assembly 736 does not inhibit the second drawer 16B from being opened or closed as desired. It should be noted that although FIG. 9C illustrates the latch assembly 712 selectively engaging and/or being operative relative to a drawer, i.e. to the second drawer 16B, the latch assembly 712 can equally selectively engage and/or be operative relative to a door 30C (illustrated in FIG. 1C) of the cabinet 10C (illustrated in FIG. 1C).

Additionally, as illustrated, the attachment assembly 734 is in the same position relative to the cabinet body 14 and/or the cabinet face 24, regardless of whether the latch assembly 712 is in the unlocked position (as shown in FIG. 9C) or the locked position (as shown in FIG. 7C). More specifically, as shown, when in the unlocked position, the first arm 844 of the attacher body 840 still provides pressure and/or contact on the back 24B of the cabinet face 24, and the second arm 846 of the attacher body 840 still provides pressure and/or contact on the front 24F of the cabinet face 24. Further, the attacher base 848 still extends underneath the portion of the cabinet face 24 that is positioned substantially between and/or adjacent to the first drawer 16A and the second drawer 16B. Still further, the attacher aligner 882 is still positioned relative to the back 24B of the cabinet face 24 so as to ensure proper orientation and alignment of the attachment assembly 734 and/or the attacher body 840 relative to the cabinet face 24.

Figure 9D:
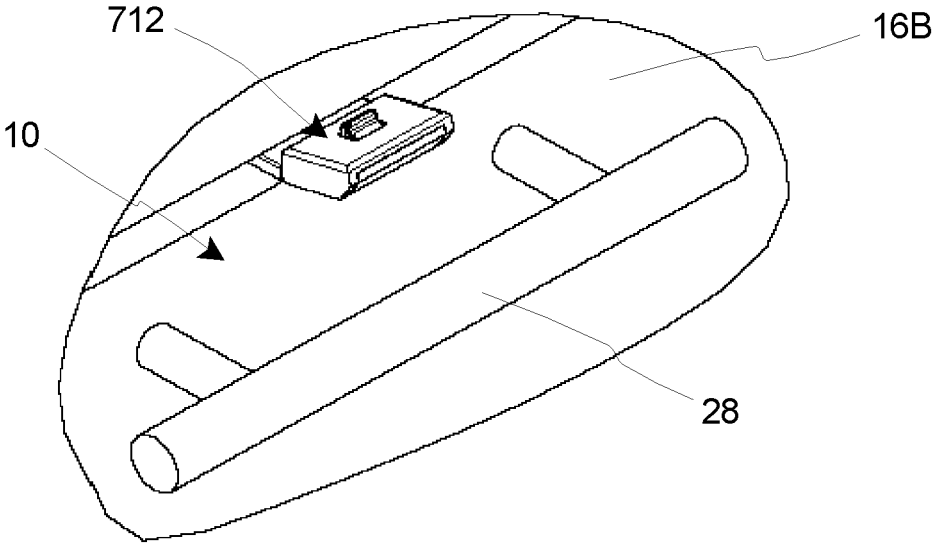
FIG. 9D is an enlarged view illustration of a portion of the cabinet and the latch assembly illustrated in FIG. 9A.

FIG. 9D is an enlarged view illustration of a portion of the cabinet 10 and the latch assembly 712 illustrated in FIG. 9A. More specifically, FIG. 9D illustrates the latch assembly 712 mounted on the second drawer 16B of the cabinet 10, and near the handle 28 of the second drawer 16B.

Figure 10A:
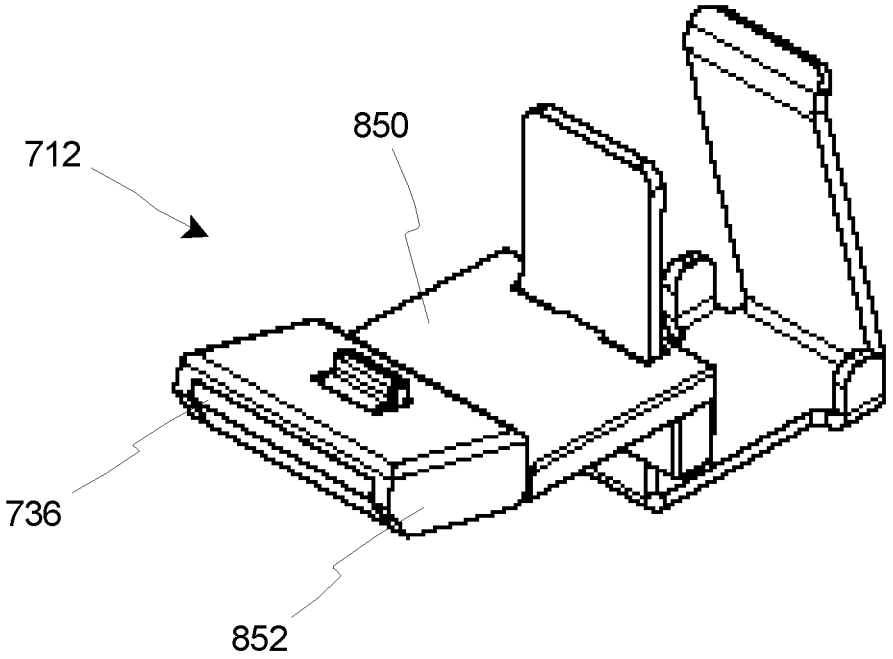
FIG. 10A is a perspective view illustration of the latch assembly illustrated in FIG. 7A, the latch assembly being shown in the unlocked position.

FIG. 10A is a perspective view illustration of the latch assembly 712 illustrated in FIG. 7A, the latch assembly 712 again being shown in the unlocked position. More particularly, FIG. 10A illustrates certain aspects of the locking assembly 736 when the latch assembly 712 is in the unlocked position. For example, as shown, the pivoting member 852 of the locking assembly 736 is now in the second position relative to the transverse member 850. In particular, the pivoting member 852 has been pivoted about the pivot pin 854 (illustrated in FIG. 10D) relative to the transverse member 850 to the second position.

As noted above, and as described in greater detail herein below, when the pivoting member 852 is in the second position, a portion of the pivoting member 852 engages a portion of the transverse member 850, and the pivoting member 852 is inhibited from pivoting relative to the transverse member 850, i.e. from the second position to the first position. However, when the pivoting member 852 is in the second position, and thus the latch assembly 712 is in the unlocked position, the pivoting member 852 allows for large scale movement of the drawer 16B (illustrated in FIG. 4A) or door 30C (illustrated in FIG. 1C) relative to the cabinet body 14 (illustrated in FIG. 4C).

Figure 10B:
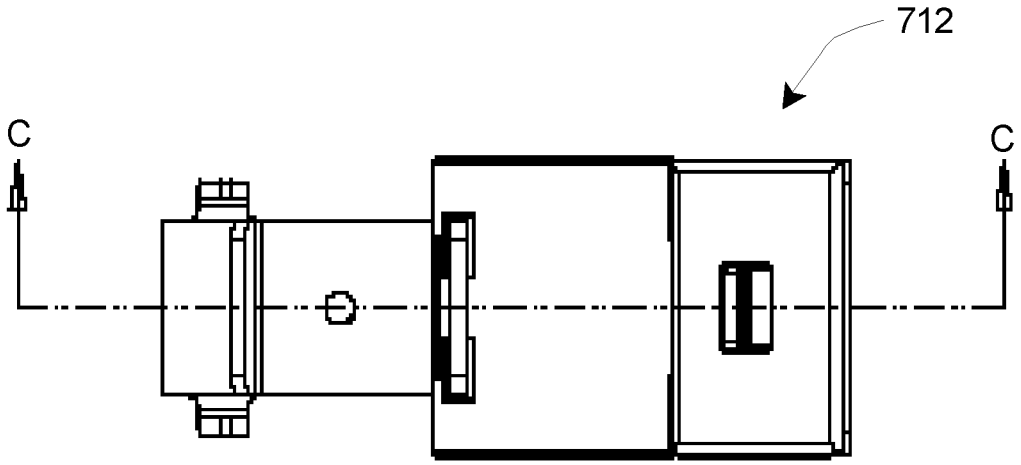
FIG. 10B is a top view illustration of the latch assembly illustrated in FIG. 10A.

FIG. 10B is a top view illustration of the latch assembly 712 illustrated in FIG. 10A.

Figure 10C:
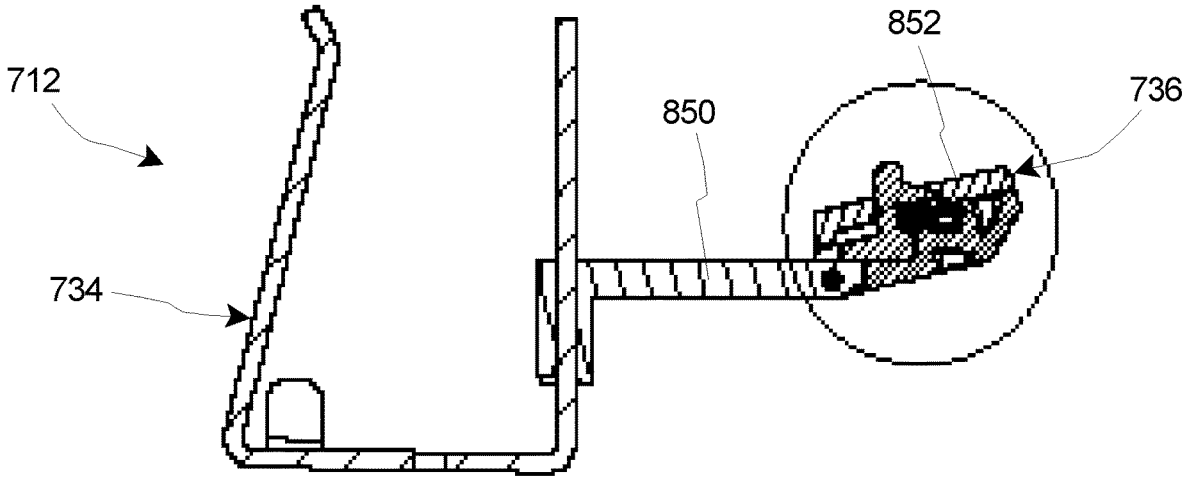
FIG. 10C is a sectional view illustration of the latch assembly taken on line C-C in FIG. 10B.

FIG. 10C is a sectional view illustration of the latch assembly 712 taken on line C-C in FIG. 10B. More particularly, FIG. 10C illustrates the relative orientation and positioning of the attachment assembly 734 and the locking assembly 736 when the latch assembly 712 is in the unlocked position. Moreover, FIG. 10C illustrates the pivoting member 852 in the second position, with the pivoting member 852 positioned substantially parallel to the transverse member 850.

Figure 10D:
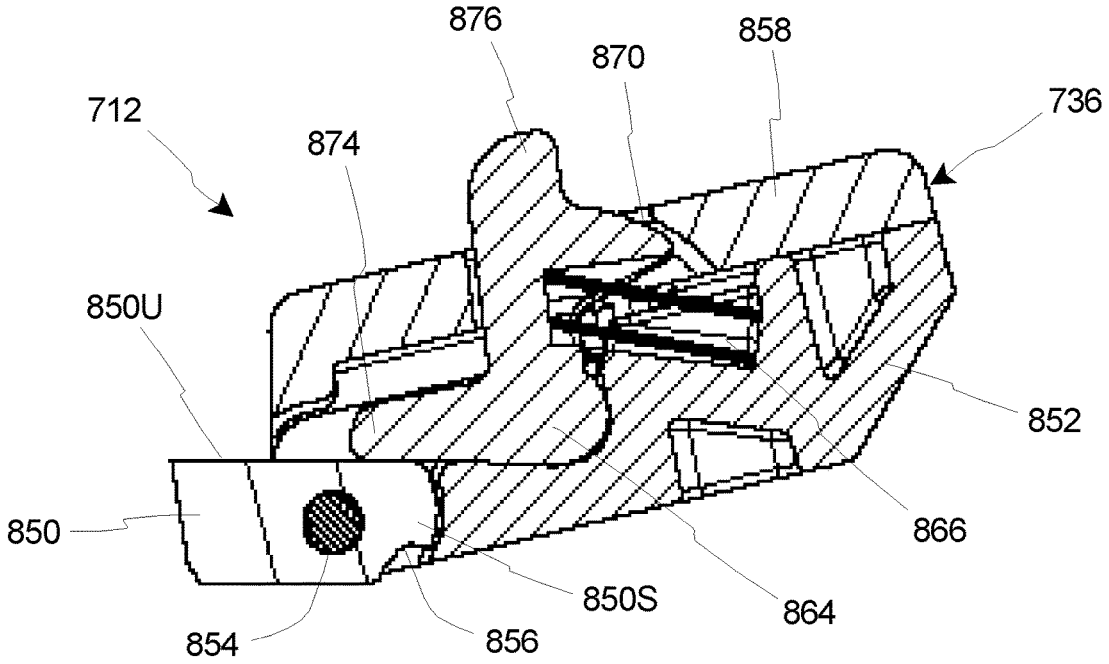
FIG. 10D is an enlarged view illustration of a portion of the sectional view illustration of the latch assembly in FIG. 10C.

FIG. 10D is an enlarged view illustration of a portion of the sectional view illustration of the latch assembly 712 in FIG. 10C. In particular, FIG. 10D is a cross-sectional view of a portion of the locking assembly 736, with the pivoting member 852 in the second position, i.e. the latch assembly 712 is in the unlocked position. As provided above, when the pivoting member 852 is in the second position, a portion of the pivoting member 852 engages a portion of the transverse member 850, and the pivoting member 852 is inhibited from pivoting relative to the transverse member 850. More specifically, as shown in FIG. 10D, when in the second position, the end tab 874 is no longer positioned within the recessed area 856 near the second end 850S of the transverse member 850. Rather, in the second position, the end tab 874 engages an upper surface 850U of the transverse member 850, i.e. when the latch assembly 712 is coupled to the top of a drawer 16 (illustrated in FIG. 1A) or door 30C (illustrated in FIG. 1C) at or near the second end 850S of the transverse member 850.

For purposes of moving the pivoting member 852 from the first position to the second position, the user can manually move the front tab 876 in a translational and/or rotational manner relative to the face plate 858, i.e. within plate aperture 870 and against the bias force provided by the one or more resilient members 866, to move the activator mechanism 864 from the engaged position to the disengaged position. As noted above, when in the engaged position, the end tab 874 is positioned substantially within the recessed area 856. Conversely, when in the disengaged position, the end tab 874 is no longer positioned within the recessed area 856. Thus, when in the disengaged position, the user can freely pivot the pivoting member 852 relative to the transverse member 850 about the pivot pin 854 to the second position, so that the latch assembly 712 is in the unlocked position. When the pivoting member 852 is in the second position and the latch assembly 712 is in the unlocked position, the face plate 858 of the pivoting member 852 is positioned substantially perpendicular to the drawer face 26 (illustrated in FIG. 9C), so that the drawer 16 or door 30C can be freely opened by the user. The user can release the front tab 876 of the activator mechanism 864 once the pivoting member 852 has been moved to the second position, and, as noted, the end tab 874 can engage the upper surface 850U of the transverse member 850.

For purposes of moving the pivoting member 852 from the second position back to the first position, the user can again manually move the front tab 876 in a translational and/or rotational manner relative to the face plate 858, i.e. within plate aperture 870 and against the bias force provided by the one or more resilient members 866. With the front tab 876 so moved, the user can then pivot the pivoting member 852 relative to the transverse member 850 about the pivot pin 854, so that the pivoting member 852 is being moved back toward the first position. Alternatively, in some embodiments, the user can simply overcome the force between the end tab 874 and the upper surface 850U of the transverse member 850 by simply rotating the pivoting member 852 from the second position back to the first position, e.g., without the specific need to manually move the front tab 876 in a translational and/or rotational manner relative to the face plate 858.

Figure 11A:
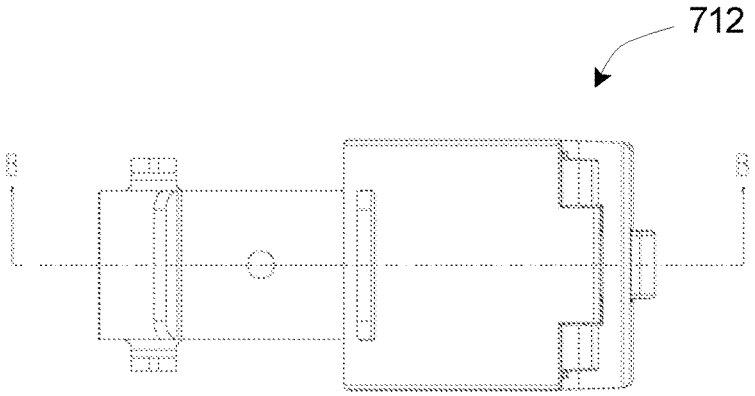
FIG. 11A is a top view illustration of the latch assembly illustrated in FIG. 7A.

FIG. 11A is a top view illustration of the latch assembly 712 illustrated in FIG. 7A.

Figure 11B:
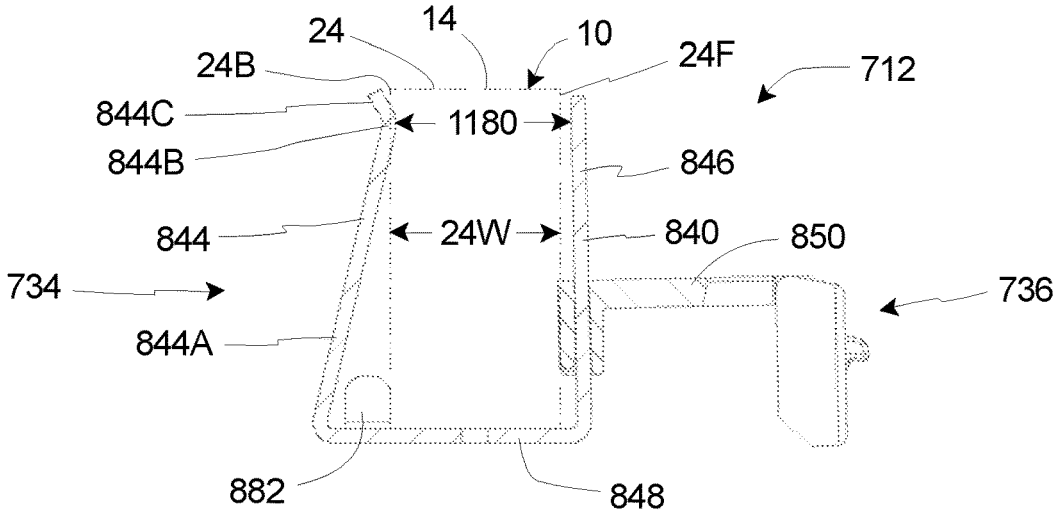
FIG. 11B is a sectional view illustration of the latch assembly taken on line B-B in FIG. 11A, with a locking assembly at a first position relative to an attachment assembly.

FIG. 11B is a sectional view illustration of the latch assembly 712 taken on line B-B in FIG. 11A. In particular, FIG. 11B is a sectional view of the locking assembly 736, and a sectional view of the attachment assembly 734, with a portion of the cabinet 10, i.e. a portion of the cabinet body 14, being shown in phantom to better illustrate the required flexing of the spring clamp during use on the cabinet 10.

As noted above, when the attachment assembly 734 is attached to the cabinet body 14 and/or the cabinet face 24 and the locking assembly 736, i.e. the transverse member 850 of the locking assembly 736, is adjustably coupled to the attachment assembly 734, the first arm 844 of the attacher body 840 is positioned to provide pressure and/or contact to the back 24B of the cabinet face 24, and the second arm 846 of the attacher body 840 is positioned to provide pressure and/or contact to the front 24F of the cabinet face 24. It is appreciated that FIG. 11B does not show any direct contact between the second arm 846 and the front 24F of the cabinet face 24; however, it is further appreciated that when the locking assembly 736, i.e. the transverse member 850, is adjustably coupled to the attachment assembly 734, the second arm 846 will be deflected so as to provide pressure to the front 24F of the cabinet face 24. Additionally, in this embodiment, the attacher base 848 is positioned substantially directly adjacent to a horizontal surface of the cabinet body 14. Further, the attacher aligner 882 is positioned along the attacher base 848 in such a manner as to be positioned substantially directly adjacent to and/or in contact with the back 24B of the cabinet face 24.

As illustrated, in one embodiment, the first arm 844 as it extends away from the attacher base 848 includes a first section 844A that angles slightly inwardly toward the second arm 846 until it reaches an inflection point 844B, and then after the inflection point 844B the first arm 844 includes a second section 844C that angles slightly outwardly away from the second arm 846. In certain such embodiments, the first arm 844 is configured so that only the inflection point 844B of the first arm 844 contacts the back 24B of the cabinet face 24 when the attachment assembly 734 is attached to the cabinet body 14 and/or the cabinet face 24. Additionally, in such embodiment, the second arm 846 can angle slightly inwardly toward the first arm 844 as it extends away from the attacher base 848. With such design, in various embodiments, no part of the second arm 846 may directly contact the front 24F of the cabinet face 24.

During use of the attachment assembly 734, the attacher body 840 is movable between a relaxed position, when the attacher body 840 is in its natural state and no pressure is applied to either of the arms 844, 846, and a clamping position, when the attachment assembly 734 and/or the attacher body 840 is attached to the cabinet body 14 and/or the cabinet face 24. As shown in FIG. 11B, the attacher body 840 is in the relaxed position. Notably illustrated is the idea that when the attacher body 840 is in the relaxed position, an arm spacing 1180 between the first arm 844 and the second arm 846 at a closest, minimum point (e.g., at the inflection point 844B) should be less than a face width 24W of the cabinet face 24 with which the latch assembly 712 is being used. Thus, in such situation, when the attacher body 840 is then positioned around the cabinet face 24, i.e. when the attacher body 840 is in the clamping position, the arm spacing 1180 between the first arm 844 and the second arm 846 will necessarily be greater than when the attacher body 840 is in the relaxed position. Thus, with the arms 844, 846 being flexibly coupled to one another via the attacher base 848, and with the arm spacing 1180 being greater when the attacher body 840 is in the clamping position, the arms 844, 846 will then be able to provide the necessary pressure and/or contact with the back 24B and the front 24F of the cabinet face 24, respectively, such that the attachment assembly 734 can be effectively held in the desired position relative to the cabinet face 24. Accordingly, it is appreciated that the latch assembly 712 can be designed to be of different sizes to be able to be effectively used with cabinets 10 and/or cabinet faces 24 of different sizes (widths).

Additionally, it is further appreciated that the design of the second section 844C of the first arm 844, which angles slightly away from the second arm 846, makes installation of the attachment assembly 734 easier, as the ends of the arms 844, 846 away from the attacher base 848 will typically be spaced apart from one another a distance that is greater than the face width 24W of the cabinet face 24 with which the latch assembly 712 is being used.

Figure 11C:
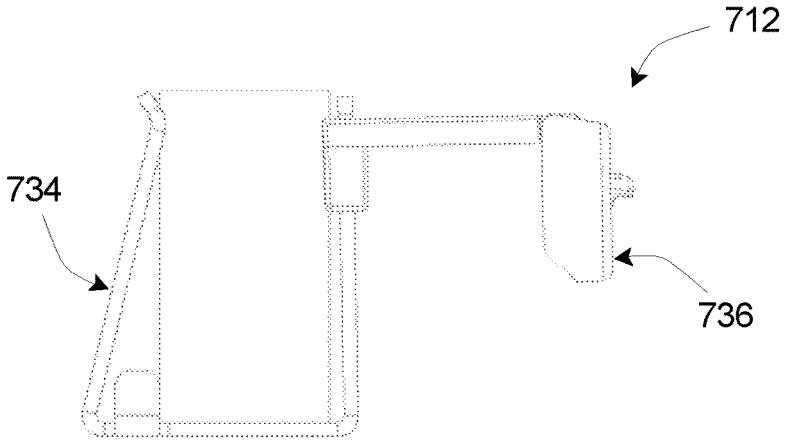
FIG. 11C is side view illustration of the latch assembly illustrated in FIG. 7A with the locking assembly at a second position relative to the attachment assembly.

FIG. 11C is side view illustration of the latch assembly 712 illustrated in FIG. 7A with the locking assembly 736 at a second position relative to the attachment assembly 734.

It should be noted that the specific designs and features of the latch assemblies as illustrated herein can be combined or omitted as desired, and additional features can be added, to allow for greater design flexibility.

Figure 12:
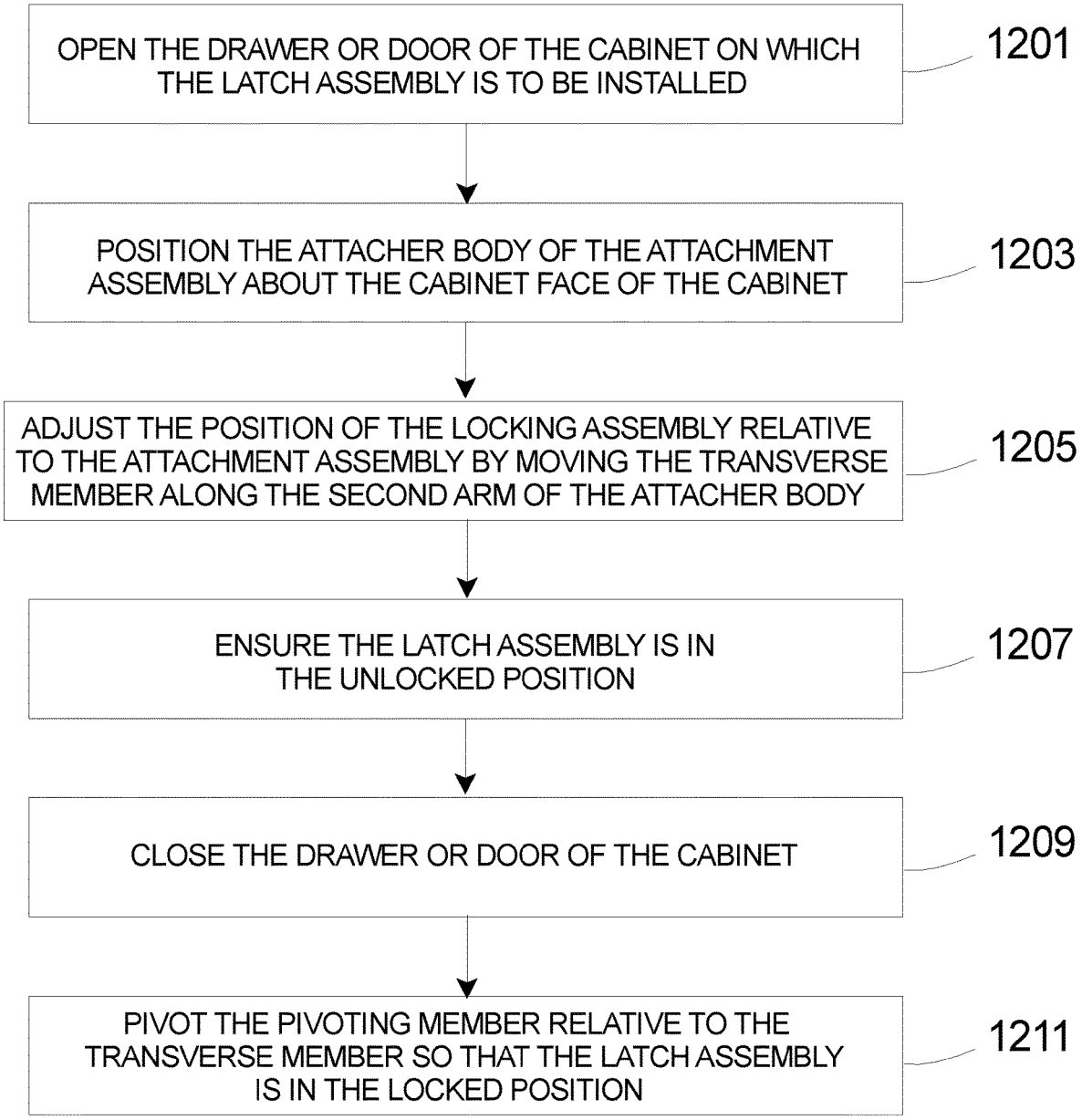
FIG. 12 is a simplified flow chart illustrating the installation and activation of the latch assembly on a cabinet.

FIG. 12 is a simplified flow chart illustrating the installation and activation of the latch assembly on a cabinet. It should be noted that any of the steps described below can be combined or omitted as desired, additional steps can be added, and/or the order of the steps can be changed, without otherwise altering the intended breadth and scope of the present invention.

In step 1201, the drawer or door of the cabinet is opened. This provides the necessary access to the portion of the cabinet face that is positioned adjacent to the drawer or door onto which the latch assembly is to be installed. Additionally, adjacent drawers or doors can also be opened, if necessary, to provide better access to the cabinet face.

In step 1203, the attacher body of the attachment assembly is positioned about the cabinet face adjacent to the drawer or door onto which the latch assembly is to be installed. During installation of the attacher body about the cabinet face, the attacher aligner is configured to ensure that the attacher body is properly oriented and/or aligned relative to the cabinet face.

Further, in step 1205, the position of the locking assembly relative to the attachment assembly can be set or adjusted, as necessary, by moving the transverse member relative to, e.g., along, the second arm of the attacher body. In one embodiment, the locking assembly is adjusted so that the transverse member will be positioned as close as reasonably possible to the edge, i.e. the top, bottom or side, of the drawer or door onto which the latch assembly is to be installed.

Additionally, in step 1207, one should ensure that the latch assembly is in the unlocked position, with the pivoting member of the locking assembly being in the second position relative to the transverse member.

Further, in step 1209, the drawer or door onto which the latch assembly is being installed is closed.

Then, in step 1211, the pivoting member is pivoted relative to the transverse member so that the pivoting member is in the first position, and the latch assembly is in the locked position.

It is understood that although a number of different embodiments of the latch assembly 12 have been illustrated and described herein, one or more features of any one embodiment can be combined with one or more features of one or more of the other embodiments, provided that such combination satisfies the intent of the present invention.

While a number of exemplary aspects and embodiments of a latch assembly 12 have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A latch assembly for use with a cabinet that includes a cabinet body having a cabinet face and a moving component that is configured to move relative to the cabinet face, the latch assembly comprising:

an attachment assembly that is selectively coupled to the cabinet face, the attachment assembly including an attacher body in the form of a spring clamp that provides pressure on a front and a back of the cabinet face when the attachment assembly is coupled to the cabinet face, the attacher body including a first arm that provides pressure on the back of the cabinet face when the attachment assembly is coupled to the cabinet face, a second arm that provides pressure on the front of the cabinet face when the attachment assembly is coupled to the cabinet face, and an attacher base that extends between the first arm and the second arm, and flexibly couples the first arm and the second arm to one another; and a locking assembly that is coupled to the attachment assembly, the locking assembly being selectively movable between a locked position, when the moving component is inhibited from moving relative to the cabinet face, and an unlocked position, when the moving component can be freely moved relative to the cabinet face, the locking assembly including a transverse member that is movably coupled to the second arm of the attacher body such that the transverse member is slidable along the second arm to adjust a position of the transverse member relative to the attacher body.

2. The latch assembly of claim 1 wherein the attacher body is movable between a relaxed position, when the attachment assembly is not coupled to the cabinet face and no pressure is applied to the first arm and the second arm, and a clamping position, when the attachment assembly is coupled to the cabinet face.

3. The latch assembly of claim 2 wherein when the attacher body is in the relaxed position, a minimum arm spacing between the first arm and the second arm is less than a face width of the cabinet face to which the attachment assembly is configured to be attached.

4. The latch assembly of claim 1 wherein the attachment assembly further includes an attacher aligner that is coupled to the attacher body, the attacher aligner being configured to align the attachment assembly relative to the cabinet face.

5. The latch assembly of claim 4 wherein the attacher aligner is positioned adjacent to the attacher base.

6. The latch assembly of claim 5 wherein the attacher aligner is positioned near where the attacher base joins the first arm; and wherein the attacher aligner is configured to be positioned adjacent to the back of the cabinet face when the attachment assembly is coupled to the cabinet face.

7. The latch assembly of claim 1 wherein the locking assembly further includes a pivoting member that is pivotally secured to the transverse member, the pivoting member pivoting relative to the transverse member between a first position in which the pivoting member is substantially perpendicular to the transverse member such that the pivoting member inhibits large scale movement of the moving component relative to the cabinet body, and a second position in which the pivoting member is substantially parallel to the transverse member such that the pivoting member allows for large scale movement of the moving component relative to the cabinet body.

8. The latch assembly of claim 7 wherein the pivoting member includes an activator mechanism that is selectively movable between an engaged position when the activator mechanism engages the transverse member to inhibit movement between the first position and the second position, and a disengaged position when the activator mechanism does not engage the transverse member and the pivoting member can pivot relative to the transverse member between the first position and the second position; and wherein movement of the activator mechanism between the engaged position and the disengaged position includes a purely rotational movement of the activator mechanism.

9. The latch assembly of claim 1 wherein the transverse member includes an aperture that is configured to fit over and be selectively maintained in position around the second arm of the attacher body due to frictional forces between the second arm and the aperture.

10. The latch assembly of claim 9 wherein the second arm has a substantially rectangular-shaped cross-section, and wherein the aperture in the transverse member is slot-shaped.

11. A latch assembly for use with a cabinet that includes a cabinet body having a cabinet face and a moving component that is configured to move relative to the cabinet face, the latch assembly comprising:

an attachment assembly that is selectively coupled to the cabinet face, the attachment assembly including an attacher body having a first arm that provides pressure on a back of the cabinet face when the attachment assembly is coupled to the cabinet face, a second arm that provides pressure on the front of the cabinet face when the attachment assembly is coupled to the cabinet face, and an attacher base that extends between the first arm and the second arm, and flexibly couples the first arm and the second arm to one another, and an attacher aligner that is coupled to the attacher body, the attacher aligner being positioned adjacent to the attacher base such that the attacher aligner is configured to align the attachment assembly relative to the cabinet face; and a locking assembly that is coupled to the attachment assembly, the locking assembly being selectively movable between a locked position, when the moving component is inhibited from moving relative to the cabinet face, and an unlocked position, when the moving component can be freely moved relative to the cabinet face.

12. The latch assembly of claim 11 wherein the attacher body is movable between a relaxed position, when the attachment assembly is not coupled to the cabinet face and no pressure is applied to the first arm and the second arm, and a clamping position, when the attachment assembly is coupled to the cabinet face; and wherein when the attacher body is in the relaxed position, a minimum arm spacing between the first arm and the second arm is less than a face width of the cabinet face to which the attachment assembly is configured to be attached.

13. The latch assembly of claim 11 wherein the locking assembly is adjustably coupled to the attachment assembly.

14. The latch assembly of claim 13 wherein the locking assembly includes a transverse member that is adjustably coupled to the attachment assembly, and a pivoting member that is pivotally secured to the transverse member, the pivoting member pivoting relative to the transverse member between a first position in which the pivoting member inhibits large scale movement of the moving component relative to the cabinet body, and a second position in which the pivoting member allows for large scale movement of the moving component relative to the cabinet body.

15. The latch assembly of claim 14 wherein the pivoting member includes an activator mechanism that is selectively movable between an engaged position when the activator mechanism engages the transverse member to inhibit movement between the first position and the second position, and a disengaged position when the activator mechanism does not engage the transverse member and the pivoting member can pivot relative to the transverse member between the first position and the second position; and wherein movement of the activator mechanism between the engaged position and the disengaged position includes a purely rotational movement of the activator mechanism.

16. The latch assembly of claim 14 wherein the transverse member of the locking assembly is movably coupled to the second arm of the attacher body such that the transverse member is slidable along the second arm to adjust a position of the transverse member relative to the attacher body.

17. The latch assembly of claim 16 wherein the transverse member includes an aperture that is configured to fit over and be selectively maintained in position around the second arm of the attacher body due to frictional forces between the second arm and the aperture.

18. The latch assembly of claim 11 wherein the attacher aligner is positioned near where the attacher base joins the first arm; and wherein the attacher aligner is configured to be positioned adjacent to the back of the cabinet face when the attachment assembly is coupled to the cabinet face.

19. A latch assembly for use with a cabinet that includes a cabinet body having a cabinet face and a moving component that is configured to move relative to the cabinet face, the latch assembly comprising:

an attachment assembly that is selectively coupled to the cabinet face, the attachment assembly including (i) an attacher body in the form of a spring clamp that provides pressure on a front and a back of the cabinet face when the attachment assembly is coupled to the cabinet face, and (ii) an attacher aligner that is coupled to the attacher body, the attacher aligner being configured to align the attachment assembly relative to the cabinet face; wherein the attacher body includes a first arm that provides pressure on the back of the cabinet face when the attachment assembly is coupled to the cabinet face, a second arm that provides pressure on the front of the cabinet face when the attachment assembly is coupled to the cabinet face, and an attacher base that extends between the first arm and the second arm, and flexibly couples the first arm and the second arm to one another; and wherein the attacher aligner is positioned about the attacher base and a portion of the first arm and the second arm; and a locking assembly that is coupled to the attachment assembly, the locking assembly being selectively movable between a locked position, when the moving component is inhibited from moving relative to the cabinet face, and an unlocked position, when the moving component can be freely moved relative to the cabinet face.

20. A latch assembly for use with a cabinet that includes a cabinet body having a cabinet face and a moving component that is configured to move relative to the cabinet face, the latch assembly comprising:

an attachment assembly that is selectively coupled to the cabinet face, the attachment assembly including an attacher body in the form of a spring clamp that provides pressure on a front and a back of the cabinet face when the attachment assembly is coupled to the cabinet face; and a locking assembly that is coupled to the attachment assembly, the locking assembly being selectively movable between a locked position, when the moving component is inhibited from moving relative to the cabinet face, and an unlocked position, when the moving component can be freely moved relative to the cabinet face;

wherein the locking assembly is adjustably coupled to the attachment assembly, the locking assembly including a transverse member that is adjustably coupled to the attachment assembly, and a pivoting member that is pivotally secured to the transverse member, the pivoting member pivoting relative to the transverse member between a first position in which the pivoting member inhibits large scale movement of the moving component relative to the cabinet body, and a second position in which the pivoting member allows for large scale movement of the moving component relative to the cabinet body; and wherein the pivoting member includes an activator mechanism that is selectively movable between an engaged position when the activator mechanism engages the transverse member to inhibit movement between the first position and the second position, and a disengaged position when the activator mechanism does not engage the transverse member and the pivoting member can pivot relative to the transverse member between the first position and the second position; and wherein movement of the activator mechanism between the engaged position and the disengaged position includes a purely rotational movement of the activator mechanism.

* * * * *